US009358435B2

(12) United States Patent
Boyd et al.

(10) Patent No.: US 9,358,435 B2
(45) Date of Patent: Jun. 7, 2016

(54) VIBRATION MODES OF FACES FOR GOLF CLUB HEADS OR OTHER BALL STRIKING DEVICES

(71) Applicant: Nike, Inc., Beaverton, OR (US)

(72) Inventors: Robert Boyd, Flower Mound, TX (US); Jeffrey A. Hadden, Delaware, OH (US); Matthew S. Young, Columbus, OH (US); Charles A. Plaxico, Westerville, OH (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/834,357

(22) Filed: Mar. 15, 2013

(65) Prior Publication Data

US 2014/0274437 A1 Sep. 18, 2014

(51) Int. Cl.

| | |
|---|---|
| ***A63B 69/36*** | (2006.01) |
| ***A63B 53/06*** | (2015.01) |
| ***A63B 53/04*** | (2015.01) |
| *A63B 71/06* | (2006.01) |

(52) U.S. Cl.

CPC ..... *A63B 53/06* (2013.01); *A63B 53/04* (2013.01); *A63B 53/047* (2013.01); *A63B 53/0466* (2013.01); *A63B 2053/042* (2013.01); *A63B 2053/0412* (2013.01); *A63B 2053/0416* (2013.01); *A63B 2053/0429* (2013.01); *A63B 2053/0433* (2013.01); *A63B 2060/002* (2015.10); *A63B 2071/0694* (2013.01); *A63B 2209/10* (2013.01); *A63B 2225/15* (2013.01)

(58) Field of Classification Search

USPC ..... 473/233, 332

See application file for complete search history.

(56) References Cited

U.S. PATENT DOCUMENTS

| | | | | |
|---|---|---|---|---|
| 5,505,453 | A | 4/1996 | Mack | |
| 5,913,709 | A * | 6/1999 | Cyr et al. | 446/418 |
| 7,413,517 | B2 * | 8/2008 | Butler et al. | 473/288 |
| 8,133,130 | B2 * | 3/2012 | Morris et al. | 473/288 |
| 2008/0004131 | A1 * | 1/2008 | Lin et al. | 473/342 |

* cited by examiner

*Primary Examiner* — Michael Dennis

(74) *Attorney, Agent, or Firm* — Banner & Witcoff, Ltd.

(57) ABSTRACT

A ball striking device, such as a golf club head, includes a face having a ball striking surface configured for striking a ball and a body connected to the face and extending rearward from the face. The head further has an indicator associated therewith, the indicator identifying a golf ball based on a vibration mode of the golf ball, such that the club head is configured to be used to strike the golf ball on the ball striking surface. In one embodiment, the face and the identified golf ball(s) may have the same or substantially the same vibration mode at one or more different swing speeds. The indicator may be positioned on the body or elsewhere on the club head, or may be alternately be positioned on a shaft connected to the head or separately from the ball striking device, such as in a written manual associated with the head.

12 Claims, 17 Drawing Sheets

VIBRATION MODES OF FACES FOR GOLF CLUB HEADS OR OTHER BALL STRIKING DEVICES

TECHNICAL FIELD

The invention relates generally to ball striking devices, such as golf clubs and heads. Certain aspects of this invention relate to golf clubs and golf club heads having a face that has a modulus that varies at different locations on the face.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. The distance and direction of ball flight can also be significantly affected by the spin imparted to the ball by the impact with the club head. Various golf club heads have been designed to improve a golfer's accuracy by assisting the golfer in squaring the club head face at impact with a golf ball.

The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is equal to the prevailing USGA limit (e.g. 0.83), which may change over time. However, because golf clubs are typically designed to contact the ball at or around the center of the face, off-center hits may result in less energy being transferred to the ball, decreasing the distance of the shot. Similarly, the contact time between the ball and the face during impact can affect energy transfer. Generally, a more flexible face will produce higher contact times, resulting in greater energy transfer. The contact time is currently limited by the USGA at 257 μs, according to the USGA Characteristic Time (CT) test. Club head features that can increase the energy transferred to a ball during impact can be advantageous.

The flexing behavior of the ball striking face and/or other portions of the head during impact can influence the energy and velocity transferred to the ball, the direction of ball flight after impact, and the spin imparted to the ball, among other factors. The flexing or deformation behavior of the ball itself during impact can also influence some or all of these factors. In many cases, the deformation behavior of the ball and the face may combine to influence the energy transferred to the ball during impact. Accordingly, a need also exists to provide a ball striking head with features that cause improved deformation behavior of the ball and/or improved combined ball and face deformation during impacts with the ball striking face of the head.

It is common for professional golfers and other experienced golfers to have higher swing speeds (i.e., the speed of the club head at or around impact with the ball) than less experienced golfers. Many club heads are designed to deliver optimal performance at higher swing speeds, and may offer less optimal performance at lower swing speeds. Accordingly, club head features that can improve performance at specific swing speeds can provide particularly advantageous performance for golfers who swing at such speeds. For example, lower swing speeds can prove to be advantageous for use by less experienced golfers.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face having a ball striking surface configured for striking a ball and a body connected to the face and extending rearward from the face. The head further has an indicator associated therewith, the indicator identifying a golf ball based on a vibration mode of the golf ball, such that the club head is configured to be used to strike the golf ball on the ball striking surface. In one embodiment, the face and the identified golf ball(s) may have the same or substantially the same vibration mode at one or more different swing speeds. The indicator may be positioned on the body or elsewhere on the club head, or may be alternately be positioned on a shaft connected to the head or separately from the ball striking device, such as in a written manual associated with the head.

According to one aspect, the indicator identifies a golf ball type, wherein the golf ball and a plurality of other golf balls belong to the golf ball type.

According to another aspect, wherein the indicator is formed by at least one of the following structures: a sticker with an adhesive connection; embossing, engraving, or other integral forming; paint, ink, dye, or other pigment; and combinations thereof.

According to a further aspect, the indicator may include alphanumeric indicia identifying the golf ball, color coded indicia identifying the golf ball, or combinations thereof.

According to yet another aspect, the indicator may further indicate a swing speed associated with the golf ball. Additionally, the indicator may further identify a second golf ball and a second swing speed associated with the second golf ball, where the second swing speed is different from the first swing speed.

Additional aspects of the invention relate to a golf club head that includes a face having a ball striking surface, a body connected to the face and extending rearward from the face, and an indicator associated with the club head. The indicator identifies a golf ball and a swing speed associated with the golf ball, such that the club head is configured to be used to strike the golf ball on the ball striking surface. In one embodiment, the face and the identified ball(s) may have the same or substantially the same vibration mode at one or more swing speeds.

According to one aspect, the indicator identifies a golf ball type, and the golf ball and a plurality of other golf balls belong to the golf ball type.

According to another aspect, the indicator further identifies a second golf ball and a second swing speed associated with the second golf ball, such that the second swing speed is different from the original swing speed. In one embodiment, the face and the second golf ball may have the same or substantially the same vibration mode at the second swing speed.

According to a further aspect, the swing speed identified by the indicator may be a range of swing speeds, which may be a numerical range, an indication of a range (e.g. low, medium, high), or other such identifications.

Further aspects of the invention relate to a golf club head that includes a face member forming a face having a ball striking surface defined by peripheral edges, and a body member connected to the face member and forming a body extending rearward from the face. The face member has a plurality of fastener holes arranged around a periphery of the face and proximate the peripheral edges of the face, and a plurality of fasteners are received in the fastener holes to connect the face member to the body member.

According to one aspect, the number of the fastener holes in the face member is greater than the number of the fasteners connecting the face member to the body member, such that at least some of the fastener holes have no fastener received therein. In this configuration, moving at least one of the fasteners to a different fastener hole, including adding a fastener to an empty hole or removing a fastener completely, may change the vibration mode of the face.

According to another aspect, tightening or loosening the fasteners may change a vibration mode of the face.

According to a further aspect, the head may also include an indicator associated therewith. The indicator identifies at least one golf ball, such that the at least one golf ball is configured for use with the face, based on a vibration mode of the golf ball. In one embodiment, the face has a first vibration mode at a first configuration or arrangement of the fasteners and a second vibration mode at a second configuration or arrangement of the fasteners. The indicator may further identify a first golf ball configured for use with the face in the first vibration mode and a second golf ball configured for use with the face in the second vibration mode.

Still further aspects of the invention relate to a golf club head that includes a face member forming a face having a ball striking surface defined by peripheral edges, and a body member connected to the face member and forming a body extending rearward from the face. The face member has a plurality of fastener holes, and a plurality of fasteners are received in the fastener holes to connect the face member to the body member. At least one of the fasteners can be adjusted to change a vibration mode of the face.

According to one aspect, the number of the fastener holes in the face member is greater than the number of the fasteners connecting the face member to the body member, such that at least some of the fastener holes have no fastener received therein. In this configuration, adjustment of at least one of the fasteners to change the vibration mode of the face may be accomplished by moving the at least one of the fasteners to a different fastener hole, including adding a fastener to a previously-empty hole or removing a fastener completely.

According to another aspect, adjustment of at least one of the fasteners to change the vibration mode of the face may be accomplished by tightening or loosening the at least one of the fasteners.

According to a further aspect, the face may have a first vibration mode at a first configuration of the fasteners and a second vibration mode at a second configuration of the fasteners. In this configuration, the head may also include an indicator that identifies a first golf ball configured for use with the face in the first vibration mode and a second golf ball configured for use with the face in the second vibration mode. The indicator may also identify a swing speed associated with at least one of the first vibration mode and the second vibration mode. The first golf ball may have a vibration mode that is substantially the same as the first vibration mode at the swing speed, and the second golf ball may have a vibration mode that is substantially the same as the second vibration mode at the swing speed.

More additional aspects of the invention relate to a wood-type golf club head that includes a face member forming a face having a ball striking surface defined by peripheral edges, and an inner surface opposite the ball striking surface, and a body member connected to the face member and having a front end and a rear end extending rearwardly from the front end to form a wood-type body extending rearward from the face. The body member and the face member define an internal cavity behind the face and define a volume of at least 400 cc. The face member has a plurality of fastener holes positioned around the peripheral edges of the ball striking surface, and the body member has fastener holes positioned on the front end that are aligned with the fastener holes of the face member. A plurality of fasteners are received through the fastener holes of the face member and the fastener holes of the body member to connect the face member to the body member. Additionally, at least one of the fasteners is adjustable to change a vibration mode of the face, as described above. The head may also include an indicator associated therewith, the indicator identifying a golf ball based on a vibration mode of the golf ball, wherein the club head is configured to be used to strike the golf ball on the ball striking surface.

Other aspects of the invention relate to golf club head kit that includes a body member having a front end with a plurality of fastener holes and forming a body extending rearward from the front end, and two or more face members configured for alternate connection to the body member. Each face member forms a face having a ball striking surface defined by peripheral edges and has a plurality of fastener holes, and can be connected to the body member by a plurality of fasteners received in the fastener holes of the face member and the fastener holes of the body member. Each of the face members have different vibration modes when connected to the body member.

According to one aspect, the fastener holes are positioned around the peripheral edges of each of the face members.

According to another aspect, each of the face members, if connected to the body member, have further adjustable vibration modes based on adjustment of the fasteners connecting the first or second face member to the body member.

Further additional aspects of the invention relate to methods that can be used to customize or adjust the vibration mode of a face of a ball striking head. For example, in one embodiment, the method includes determining a swing speed for a golfer and selecting a golf club head for use by the golfer in striking a golf ball. The golf club head includes a face having a ball striking surface configured for striking the golf ball and a body connected to the face and extending rearward from the face, and the face of the golf club head has a vibration mode that is the same as a vibration mode of the golf ball at the swing speed.

In another embodiment, the method can be used in connection with a body member having a front end with a plurality of fastener holes and forming a body extending rearward from the front end. The method includes determining a swing speed for a golfer and then selecting a selected face member from a plurality of face members having different vibration modes, based on the swing speed and a vibration mode of the selected face member. Each of the plurality of face members forms a face having a ball striking surface defined by peripheral edges, and each of the plurality of face members have a plurality of fastener holes. The selected face member is then connected to the body member by connecting a plurality of fasteners within the fastener holes of the selected face member and the fastener holes of the body member to connect the selected face member to the body member. The method may also include adjusting at least one of the plurality of fasteners to change the vibration mode of the selected face member after connection to the body member.

In a further embodiment, the method can be used in connection with a golf club head that has a face member forming a face having a ball striking surface defined by peripheral edges, a body member connected to the face member and forming a body extending rearward from the face, and a plurality of fasteners received in fastener holes of the face member to connect the face member to the body member. In this embodiment, the vibration mode of the face is adjusted or changed by adjusting at least one of the plurality of fasteners. Adjusting at least one of the plurality of fasteners may include: (a) moving the at least one of the fasteners to a different fastener hole, (b) adding at least one additional fastener to at least one previously-empty fastener hole, (c) removing the at least one of the fasteners from at least one of the fastener holes, and/or (d) tightening or loosening the at least one of the fasteners.

Still other aspects of the invention relate to golf clubs that include a golf club head as described above and a shaft connected to the head, or a set of golf clubs including at least one golf club having a head as described above. In one embodiment, the shaft and/or the head may have an indicator as described above located thereon.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

Figure 1:
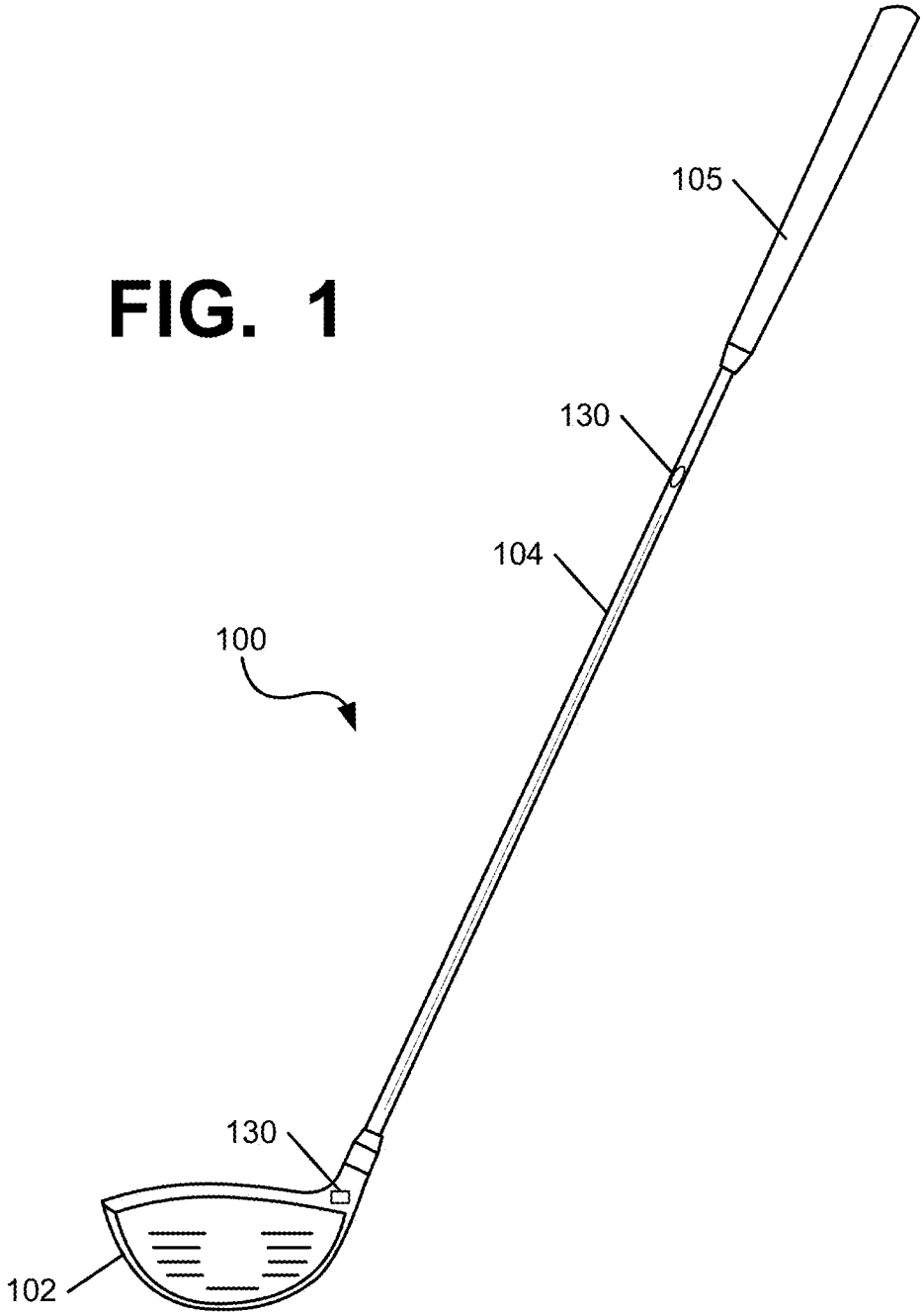
FIG. 1 is a front view of an illustrative embodiment of a wood-type ball striking device according to aspects of the present invention.

It is understood that the relative sizes and degrees of deformation of the components shown in FIGS. 3-5 and 18 may be exaggerated in order to show relevant detail.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage thereto.

"Substantially same vibration mode" means that two components, during impact with each other, deform at relative vibration frequencies that are within +/−10% of each other. It is understood that such components may have substantially the same vibration mode at a particular impact speed, at a small or large range of impact speeds, or at any impact speed, as may be further specified herein.

In general, aspects of this invention relate to ball striking devices, such as golf club heads, golf clubs, and the like. Such ball striking devices, according to at least some examples of the invention, may include a ball striking head and a ball striking surface. In the case of a golf club, the ball striking surface is a substantially flat surface on one face of the ball striking head. It is understood that some golf clubs or other ball striking devices may have more than one ball striking surface. Some more specific aspects of this invention relate to wood-type golf clubs and golf club heads. Alternately, some aspects of this invention may be practiced with iron-type golf clubs and golf club heads, hybrid clubs, chippers, putters, etc.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other composites. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to the invention relate to golf club head structures, including heads for wood-type golf clubs, such as drivers, fairway woods, etc. Other examples of ball striking devices according to the invention may relate to iron-type golf clubs, such as long iron clubs (e.g., driving irons, zero irons through five irons), short iron clubs (e.g., six irons through pitching wedges, as well as sand wedges, lob wedges, gap wedges, and/or other wedges), as well as hybrid clubs, putters, chippers, and other types of clubs. Such devices may include a one-piece construction or a multiple-piece construction. Example structures of ball striking devices according to this invention will be described in detail below in conjunction with FIG. 1, which illustrates an example of a ball striking device 100 in the form of a golf driver, and FIG. 19, which illustrates an example of a ball striking device 800 in the form of an iron-type golf club, in accordance with at least some examples of this invention.

FIGS. 1-5 illustrate a ball striking device 100 in the form of a golf driver, in accordance with at least some examples of the invention, and FIGS. 6-18 illustrate various additional embodiments of a golf driver in accordance with aspects of the invention. As shown in FIG. 1, the ball striking device 100 includes a ball striking head 102 and a shaft 104 connected to the ball striking head 102 and extending therefrom. The ball striking head 102 of the ball striking device 100 of FIG. 1 has a face 112 connected to a body 108, with a hosel 109 extending therefrom. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver, intended to hit the ball 106 (shown in FIGS. 3-5) accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

In the illustrative embodiment illustrated in FIGS. 1-5, the head 102 has a hollow structure defining an inner cavity 107 (e.g., defined by the face 112 and the body 108). Thus, the head 102 has a plurality of inner surfaces defined therein. In one embodiment, the hollow inner cavity 107 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity 107 may not be completely enclosed in some embodiments. In the embodiment illustrated in FIGS. 1-4, the body 108 of the head 102 has a squared or rectangular rear profile. In other embodiments, the body 108 of the head 102 can have another shape or profile, including a rounded shape or other any of a variety of other shapes. It is understood that such shapes may be configured to distribute weight away from the face 112 and/or the geometric/volumetric center of the head 102, in order to create a lower center of gravity and/or a higher moment of inertia. The body 108 may be connected to a hosel 109 for connection to a shaft 104, as described below.

The face 112 is located at the front 124 of the head 102, and has a ball striking surface 110 located thereon and an inner surface 111 (FIGS. 3-5) opposite the ball striking surface 110. The ball striking surface 110 is typically an outer surface of the face 112 configured to face a ball 106 in use, and is adapted to strike the ball 106 when the device 100 is set in motion, such as by swinging. The face 112 is defined by peripheral edges, including a top edge 113, a bottom edge 115, a heel edge 117, and a toe edge 119. Additionally, in this embodiment, the face 112 has a plurality of face grooves 121 on the ball striking surface 110, which do not extend across the hot zone at the center of the face 112. In another embodiment, such as a fairway wood head a hybrid wood-type head, the face 112 may have grooves 121 that extend across at least a portion of the hot zone of the face 112.

As shown, the ball striking surface 110 is relatively flat, occupying most of the face 112. For reference purposes, the portion of the face 112 nearest the top face edge 113 and the heel 120 of the head 102 is referred to as the "high-heel area" the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. For example, in one embodiment, face 112 may be wholly or partially formed by a face member with the body 108 being partially or wholly formed by a body member including one or more separate pieces connected to the face member. FIGS. 6-15, described below, illustrate embodiments that contain a face member connected to a body member. These pieces may be connected by an integral joining technique, such as welding, cementing, or adhesively joining. Other known techniques for joining these parts can be used as well, including many mechanical joining techniques, including fasteners and other releasable mechanical engagement techniques. If desired, the hosel 109 may be integrally formed as part of the body member or the face member. Further, a gasket (not shown) may be included between the face member and the body member in some embodiments.

The ball striking device 100 may include a shaft 104 connected to or otherwise engaged with the ball striking head 102, as shown in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

Figure 1A:
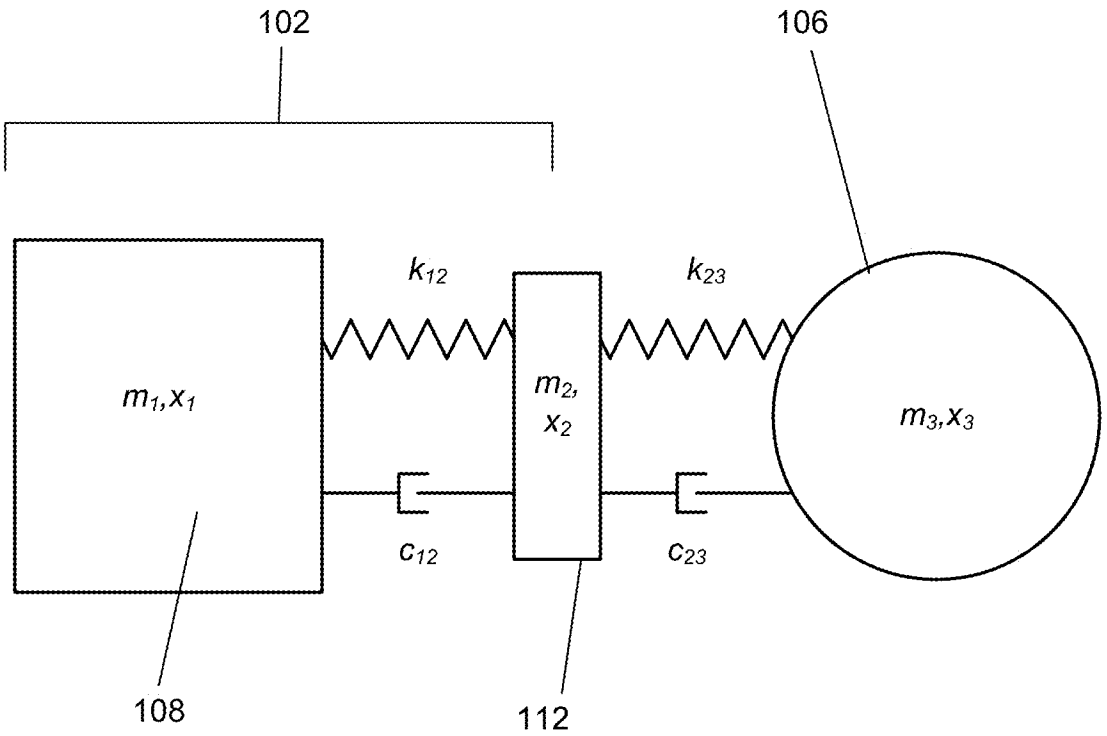
FIG. 1A is a schematic model illustrating potential physics of an impact between a ball and a face of a ball striking head.

In general, the head 102 has a face 112 that is matched with one or more particular balls 106, such that the face 112 and the selected ball(s) 106 have the same or substantially the same vibration modes. FIG. 1A illustrates a diagram similar to a model proposed by Cochran, "Development and use of one-dimensional models of a golf ball," Journal of Sports Sciences, 2002, 20, 635-641, which is incorporated by reference herein in its entirety. In FIG. 1A, $m_1$ and $x_1$ represent the mass and natural frequency (or vibration mode) of the body 108 of the head 102, $m_2$ and $x_2$ represent the mass and natural frequency (or vibration mode) of the face 112 of the head 102, and $m_3$ and $x_3$ represent the mass and natural frequency (or vibration mode) of the ball 106, also referred to as the ovalization mode of the ball 106. Additionally, $k_{12}$ and $c_{12}$ represent the stiffness and damping, respectively, of the face 112, and $k_{23}$ and $c_{23}$ represent the stiffness and damping, respectively, of the ball 106. This model may be described by the following equations of motion:

$$m_1(d^2x_1/dt^2)+c_{12}(dx_1/dt-dx_2/dt)+k_{12}(x_1\cdot x_2)=0$$

$$m_2(d^2x_2/dt^2)-c_{12}(dx_1/dt-dx_2/dt)-k_{12}(x_1\cdot x_2)+c_{23}(dx_2/dt-dx_3/dt)+k_{23}(x_2\cdot x_3)=0$$

$$m_3(d^2x_3/dt^2)-c_{23}(dx_2/dt-dx_3/dt)-k_{23}(x_2-x_3)=0$$

This system of equations may be solved using a numerical integration technique along with the following initial conditions:

$$x_1(0)=dx_1(0)/dt=V_0$$

$$x_2(0)=0,\ dx_2(0)/dt=V_0$$

$$x_3(0)=dx_3(0)/dt=0$$

where $V_0$ is the initial velocity of the club head and the face.

Figure 1B:
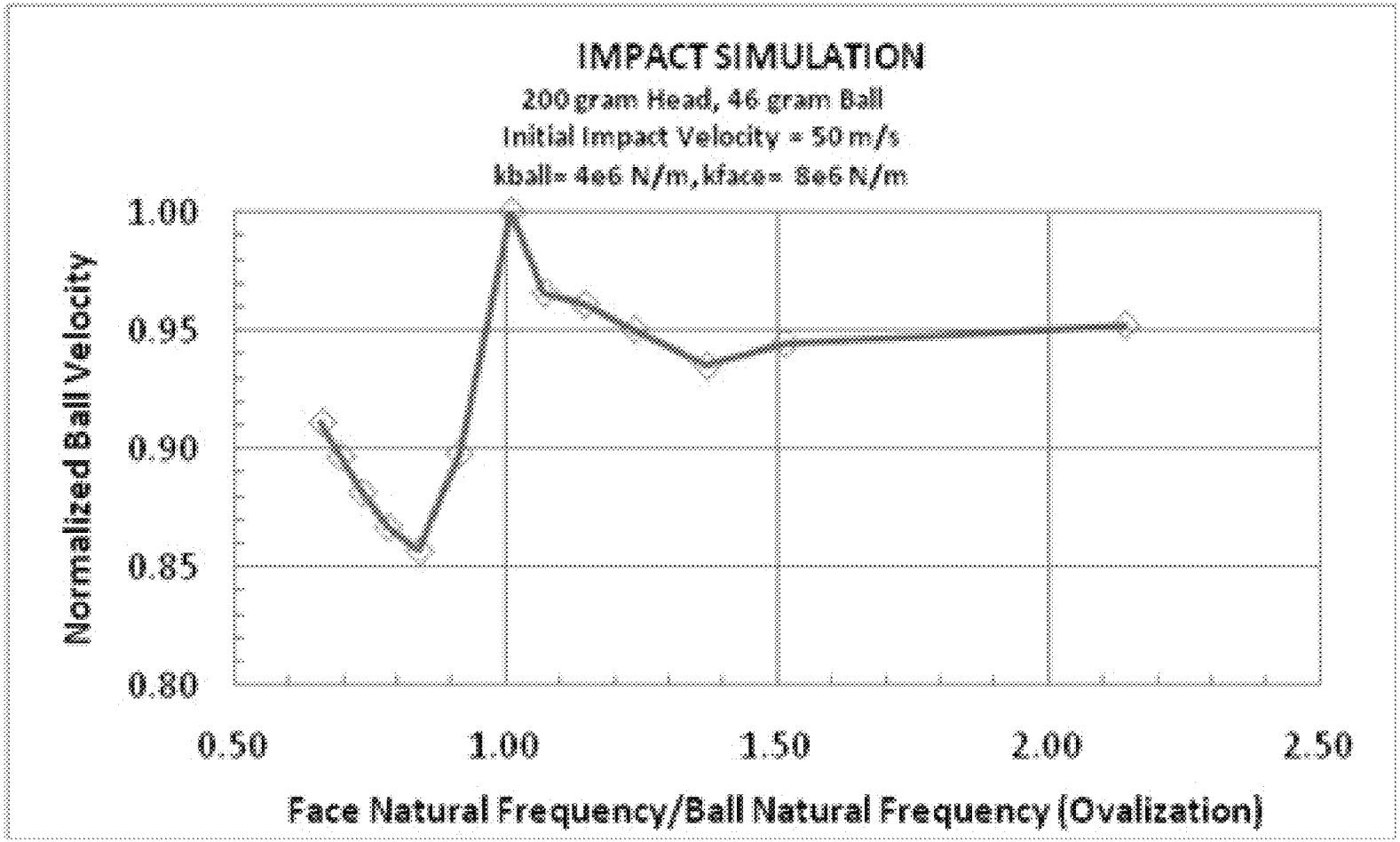
FIG. 1B is a graph showing ball velocity versus the ratio of the vibration mode of the face to the vibration mode of the ball, based on an impact simulation.

The above-described model was tested in an impact simulation using a 200 gram head and a 46 gram ball, with an initial impact velocity ($V_0$) of 54 m/s, a kball of $4\times10^6$ N/m and a kface of $8\times10^6$N/m. The results of this impact simulation are described in FIG. 1B, which shows a plot of ball velocity versus the ratio of the natural frequency (i.e. vibration mode) of the face to the natural frequency (i.e. vibration mode) of the ball in its lowest ovalization mode. The ball velocity is normalized to the highest velocity calculated for the simulation. These results show that the normalized ball velocity after impact was maximized when the ratio of the natural frequency or vibration mode of the face ($x_2$) to the natural frequency or vibration mode of the ball ($x_3$) approached 1.0. Additionally, the testing showed that significantly higher ball velocity can be achieved when the vibration modes of the face and the ball are within about +/−10% of the 1:1 ratio. Further, the testing showed that the lowest ball velocities were produced when the vibration mode of the face was a lower frequency than the vibration mode of the ball. This suggests that it is possible to maximize ball velocity and distance by selecting face mass and stiffness properties that tune the face dynamics to the ball dynamics. Accordingly, in one embodiment, the vibration modes of the face and the ball may be about 1:1, in another embodiment, the vibration modes of the face and the ball may be within about +/−10% of a 1:1 ratio, and in a further embodiment, the vibration mode of the face may be a substantially equal or greater frequency than the vibration mode of the ball.

It is understood that the vibration mode of the face 112 and/or the vibration mode of the ball 106 may change at a different impact speed, and that in some embodiments, the vibration modes of these components may be the same or substantially the same at a specific speed, a small or large range of speeds, or at any speed. Additionally, the relevant vibration mode of the face 112 may be different at different locations on the face 112. Typically, the vibration mode of the face 112 is matched with the vibration mode of the ball 106 at least around the area of highest response 127 of the face 112, but may be additionally or alternately matched at other locations.

The vibration mode (also referred to herein as natural frequency) of an article or material may be tested and/or determined using a variety of different techniques known to those skilled in the art, including various "modal testing" or "modal vibration testing" techniques. Some examples of such techniques are described in Ewings, D. J., *Modal Testing: Theory, Practice and Application: 2nd Edition*, Research Studies Press, Ltd, Hertfordshire, England and Philadelphia, Pa., 2000. Specific examples of modal testing techniques include impact hammer modal testing and shaker modal testing. These testing methods may utilize a dynamic signal analyzer and a computer connected to the signal analyzer to collect and output the data. Other testing methods may be used as well, if applicable.

Impact hammer testing is based on the idea that an ideal impact to a structure is a perfect impulse, which has an infinitely small duration, causing a constant amplitude in the frequency domain, and which would result in all modes of vibration being excited with equal energy. The impact hammer test is designed to replicate this; however, in reality a hammer strike cannot last for an infinitely small duration, but has a known contact time. The duration of the contact time directly influences the frequency content of the force, with a larger contact time causing a smaller range of bandwidth. A load cell is attached to the end of the hammer to record the force.

Shaker testing utilizes a shaker, which is a device that excites the object or structure according to its amplified input signal. Several input signals are available for modal testing, but the sine sweep and random frequency vibration profiles are the most commonly used signals. Objects or structures can be attached directly to the shaker table. With some types of shakers, an armature is often attached to the body to be tested by way of piano wire (pulling force) or stinger (pushing force). When the signal is transmitted through the piano wire or the stinger, the object responds the same way as impact testing, by attenuating some and amplifying certain frequencies. These frequencies are measured as modal frequencies. Usually a load cell is placed between the shaker and the structure to obtain the excitation force. Several types of shakers are common: rotating mass shakers, electro-dynamic shakers, and electrohydraulic shakers. For rotating mass shakers, the force can be calculated from knowing the mass and the speed of rotation; for the electro-dynamic shaker, the force can be obtained through a load cell, or an accelerometer placed on the moving mass of the shaker.

Figure 2:
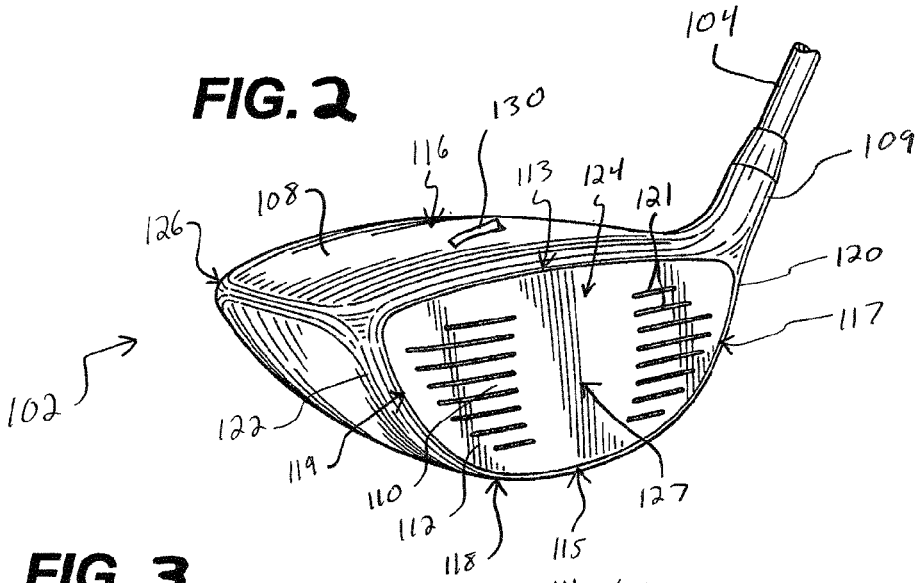
FIG. 2 is a perspective view of a head of the ball striking device of FIG. 1.
Figure 3:
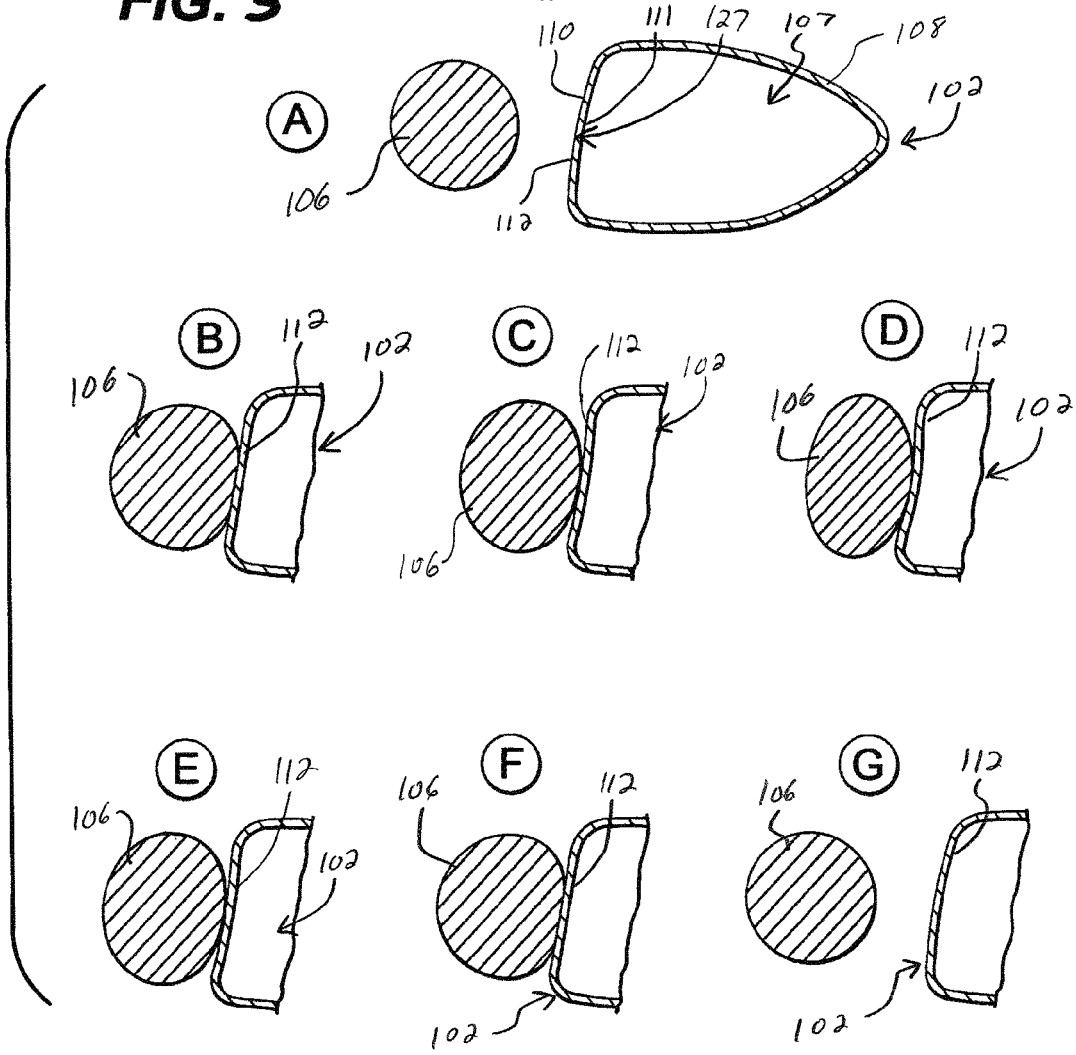
FIG. 3 is a schematic diagram illustrating sequential stages of an impact between a face of the head of FIG. 2 and a ball having substantially the same vibration mode as the face, shown in partial cross-section view, with the stages sequentially identified as FIGS. 3A-3F.
Figure 4:
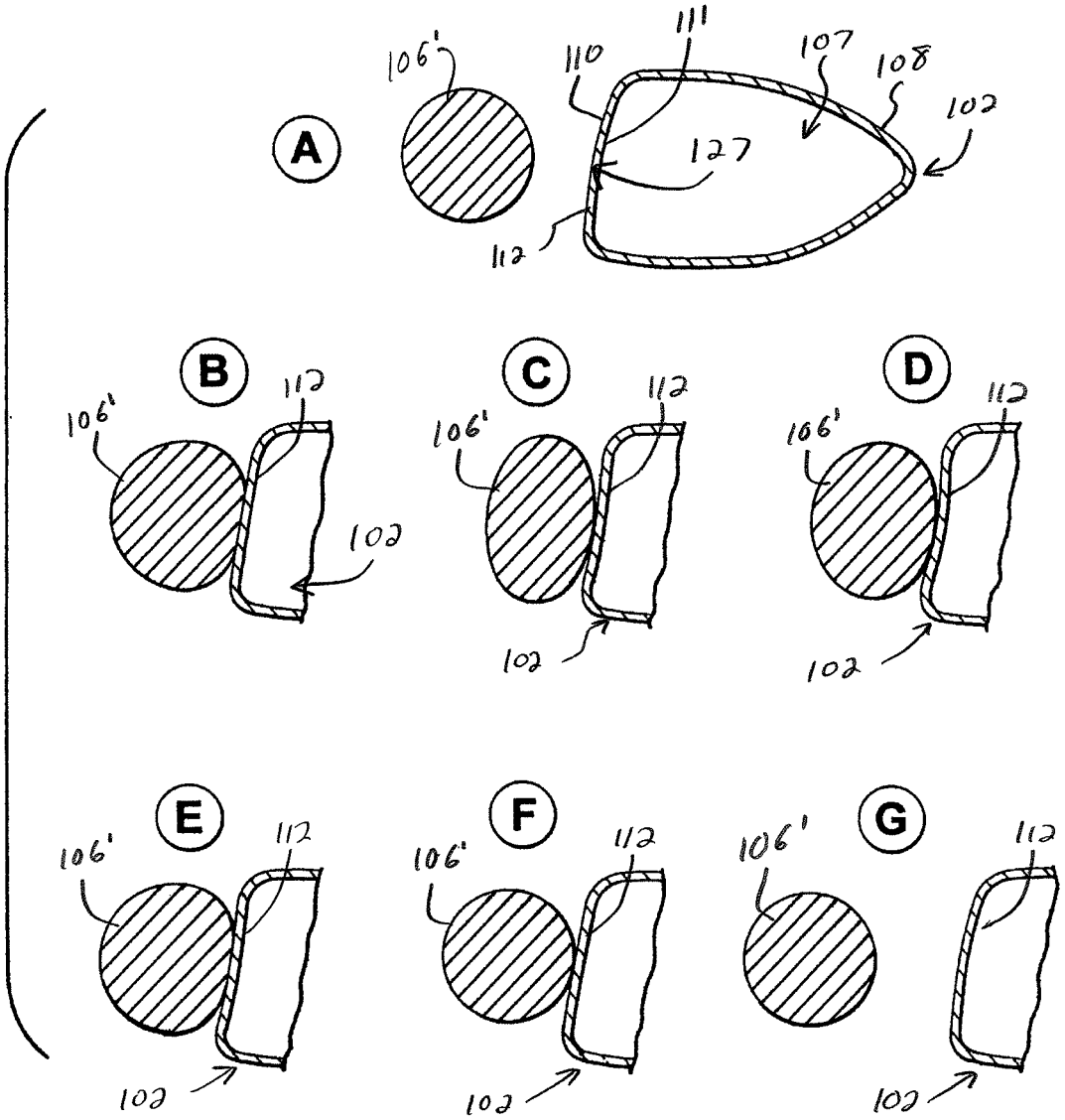
FIG. 4 is a schematic diagram illustrating sequential stages of an impact between a face of the head of FIG. 2 and a ball having a shorter vibration mode than the face, shown in partial cross-section view, with the stages sequentially identified as FIGS. 4A-4F.
Figure 5:
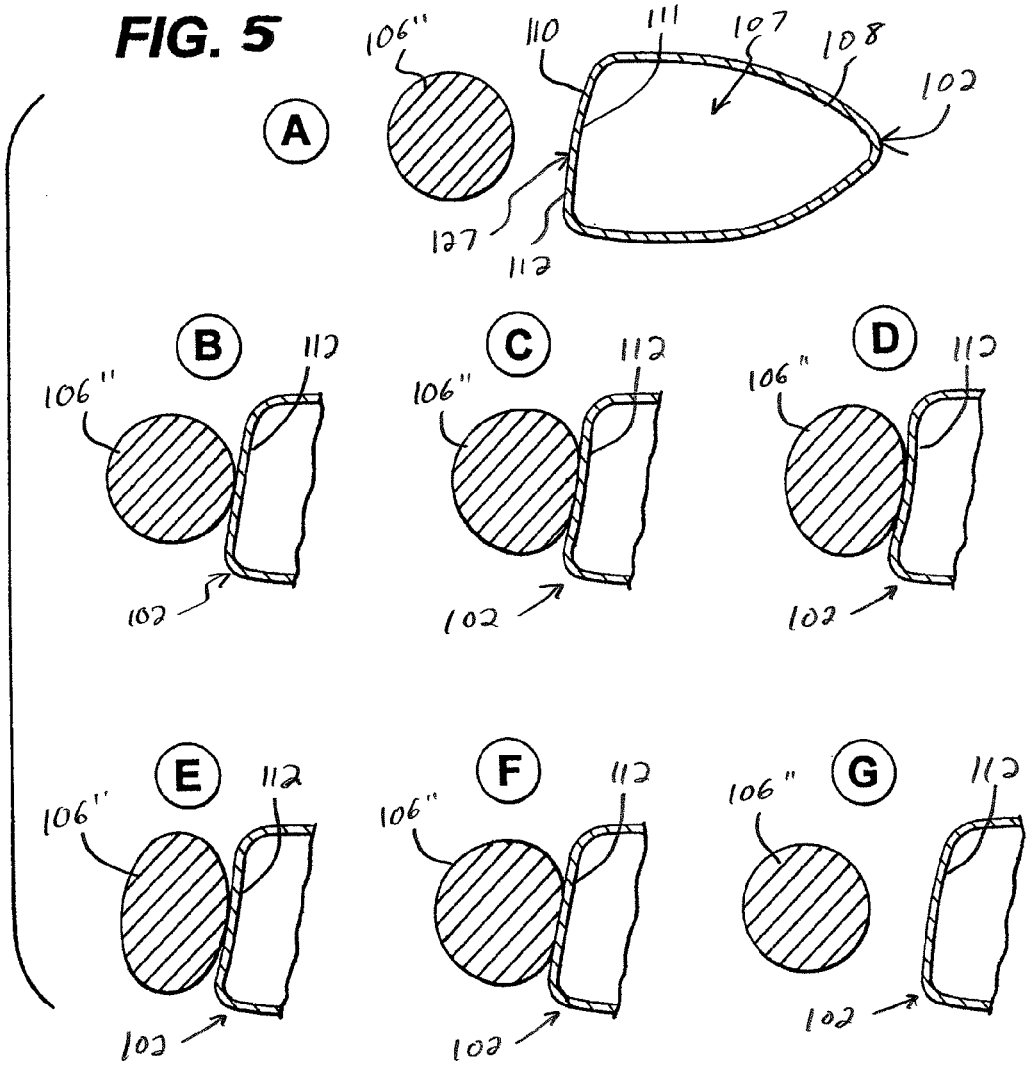
FIG. 5 is a schematic diagram illustrating sequential stages of an impact between a face of the head of FIG. 2 and a ball having a longer vibration mode than the face, shown in partial cross-section view, with the stages sequentially identified as FIGS. 5A-5F.

FIGS. 3-5 illustrate the head 102 of FIGS. 1-2 impacting three different golf balls 106, 106', and 106". FIG. 3 illustrates an impact between the head 102 and a ball 106 that has the same or substantially the same vibration mode as the face 112, illustrating the progression of the impact sequentially in FIGS. 3A-3F. As shown in FIG. 3A, the face 112 travels toward the ball 106 and impacts the ball 106 at FIG. 3B, slightly deforming both the face 112 and the ball 106. As shown in FIG. 3C, the ball 106 and face 112 deform gradually more due to the force of the impact until both the ball 106 and the face 112 reach maximum deformation at the same time, due to the similar vibration modes, illustrated in FIG. 3D. In FIGS. 3E and 3F, the ball 106 and the face 112 begin to gradually return to their original shapes, pushing against each other while doing so. In FIG. 3G, the ball 106 is propelled away from the face 112 with energy resulting from the impact, and both the ball 106 and the face 112 have fully returned to shape. The face 112 and the ball 106 deform and return to shape substantially contemporaneously, due to the similar vibration modes, which can result in increased energy transfer relative to impacts involving substantially different vibration modes.

FIG. 4 illustrates an impact between the face 112 and a ball 106' where the ball 106' has a shorter vibration mode (i.e. higher frequency) than the face 112. As shown in FIG. 4A, the face 112 travels toward the ball 106' and impacts the ball 106' at FIG. 4B, deforming both the face 112 and the ball 106'. The ball 106' reaches maximum deformation in FIG. 4C, however the face 112 continues to deform and reaches maximum deformation at FIG. 4D, where the ball 106' has already begun to return to shape. In FIG. 4E, both the ball 106' and the face 112 are gradually returning to shape, and in FIG. 4F, the ball 106' has nearly returned to shape and is leaving the face 112 before the face 112 has returned fully to shape. In FIG. 4G, the ball 106' is propelled fully away from the face 112 with energy resulting from the impact, and both the ball 106' and the face 112 have fully returned to shape. This difference in vibration modes between the ball 106' and the face 112 can result in dissipation of impact energy by the ball 106' and/or the face 112 and less energy transfer, such as compared to the ball 106 and face 112 of FIG. 3.

FIG. 5 illustrates an impact between the face 112 and a ball 106" where the ball 106" has a longer vibration mode (i.e. lower frequency) than the face 112. As shown in FIG. 5A, the face 112 travels toward the ball 106" and impacts the ball 106" at FIG. 5B, deforming both the face 112 and the ball 106". The ball 106" and the face 112 continue to deform through FIG. 5C, and the face 112 reaches maximum deformation in FIG. 5D. However the ball 106" continues to deform and reaches maximum deformation at FIG. 5E, where the face 112 has already begun to return to shape. In FIG. 5F, both the ball 106" and the face 112 are gradually returning to shape, and in FIG. 5G, the ball 106" is propelled fully away from the face 112 with energy resulting from the impact, with both the ball 106" and the face 112 having fully returned to shape. This difference in vibration modes between the ball 106" and the face 112 can result in dissipation of impact energy by the ball 106" and/or the face 112 and less energy transfer, such as compared to the ball 106 and face 112 of FIG. 3.

In one embodiment, illustrated in FIGS. 1-2, the head 102 may have an indicator 130 associated therewith, to identify one or more balls 106 that are configured for use with the head 102, based on the vibration modes of the face 112 and/or the ball 106. For example, the indicator 130 may identify one or more balls 106 that have the same or substantially the same vibration mode as the face 112. The indicator 130 may identify one or more balls 106 by identifying a type of ball that includes a plurality of different balls (or multiple types), or by identifying one or more balls 106 individually, such as by brand, model number, etc. The indicator 130 may also identify a first golf ball 106 configured for use with the face 112 in one vibration mode (such as at a particular swing speed) and at least one other golf ball 106 configured for use with the face 112 in at least one other vibration mode (such as a different swing speed). As shown in FIGS. 1-2, the indicator 130 may be in the form of indicia positioned on the head 102 and/or the shaft 104 of the golf club 100. In one embodiment, the indicator 130 may be positioned on the body 108 of the head 102, such as on the top 116 or the sole 118. In another embodiment, the indicator 130 may be separate from the golf club 100, such as on a tag attached to the club 100, on packaging materials for the club 100, or in a written manual that is packaged or otherwise associated with the club 100, among others.

Additionally, the indicator 130 may identify the ball(s) 106 in many different ways. For example, the indicator 130 may include a verbal or other alphanumeric indicia identifying one or more balls 106, which may correspond to a coding scheme, such that a particular code identifies one or more balls 106. One such coding scheme may be high-frequency (HF), mid frequency (MF), or low frequency (LF), with corresponding balls 106 identified accordingly. A different type of coding scheme may also be used, such as a color coding scheme, or another type of non-alphanumeric identifier.

Further, if the indicator 130 is located on the head 102 or elsewhere on the club 100, the indicator may be connected to the club 100 in several different ways. For example, the indicator 130 may be integrally formed with the club 100, such as being engraved, embossed, pressed, forged, molded, etc. onto the head 102 or the shaft 104, or connected using an integral joining technique. As another example, the indicator 130 may be printed or otherwise applied to the club 100, such as by paint, ink, dye, or other pigment. As a further example, the indicator 130 may be adhesively connected to the club 100, such as a sticker/label.

The indicator 130 may further identify a swing speed in connection with identification of the ball(s) 106. In one embodiment, the indicator 130 may identify one or more balls 106 that are configured for use with the head 102 at a particular swing speed, such as balls 106 that have the same or substantially the same vibration mode as the face 112 at a particular swing speed. The indicator 130 may further identify several different swing speeds, with one or more different balls 106 that are configured for use with the head 102 at each swing speed. For example, the indicator 130 may identify one type of ball 106 to use with a low swing speed and another type of ball 106 to use with a mid-range or high swing speed, and may further identify a type of ball 106 that is configured for use with the head 102 at all swing speeds. The swing speeds may be identified by the indicator 130 in different ways, such as by specific identification, identification of numeric ranges of swing speeds, identification by general range (e.g. high-speed, medium-speed, low-speed), a coding system, etc. Further, the head 102 may have a single indicator 130 that identifies the ball(s) 106 and the associated swing speed(s), or multiple indicators 130, one identifying the ball(s) 106 and another identifying associated swing speed(s). Likewise, multiple indicators 130 may be used for multiple balls 106 and/or swing speeds. Still other types of indicators 130 are possible and contemplated for use in connection with other embodiments.

In some cases, certain features of the face 112 can affect the vibration mode of the face 112 or portions of the face 112, and can be used to match the vibration mode of the face 112 to a ball 106. For example, features that change the stiffness or modulus of the face 112 or portions of the face 112 can affect the vibration mode and allow the vibration mode of the face 112 to be matched to a particular ball 106. For example, in some embodiments, face inserts or other face members may be connected to a body member forming at least part of the body 108 of the head 102 in order to change the vibration mode of at least a portion of the face 112. FIGS. 6-15 illustrate embodiments that include face inserts or other face members connected to the head 102 to affect the vibration mode of the face 112. Other features that affect the modulus of the face 112 may also be used to affect the vibration mode of the face 112. For example, surface treatments such as carburization, case hardening, plasma etching, peening, etc., can change the modulus and the vibration mode of at least a portion of the face 112, and such surface treatments may be applied to one or both of the inner surface 111 and the ball striking surface 110. Still other features may be used to affect the vibration mode of the face in other embodiments.

Figure 6:
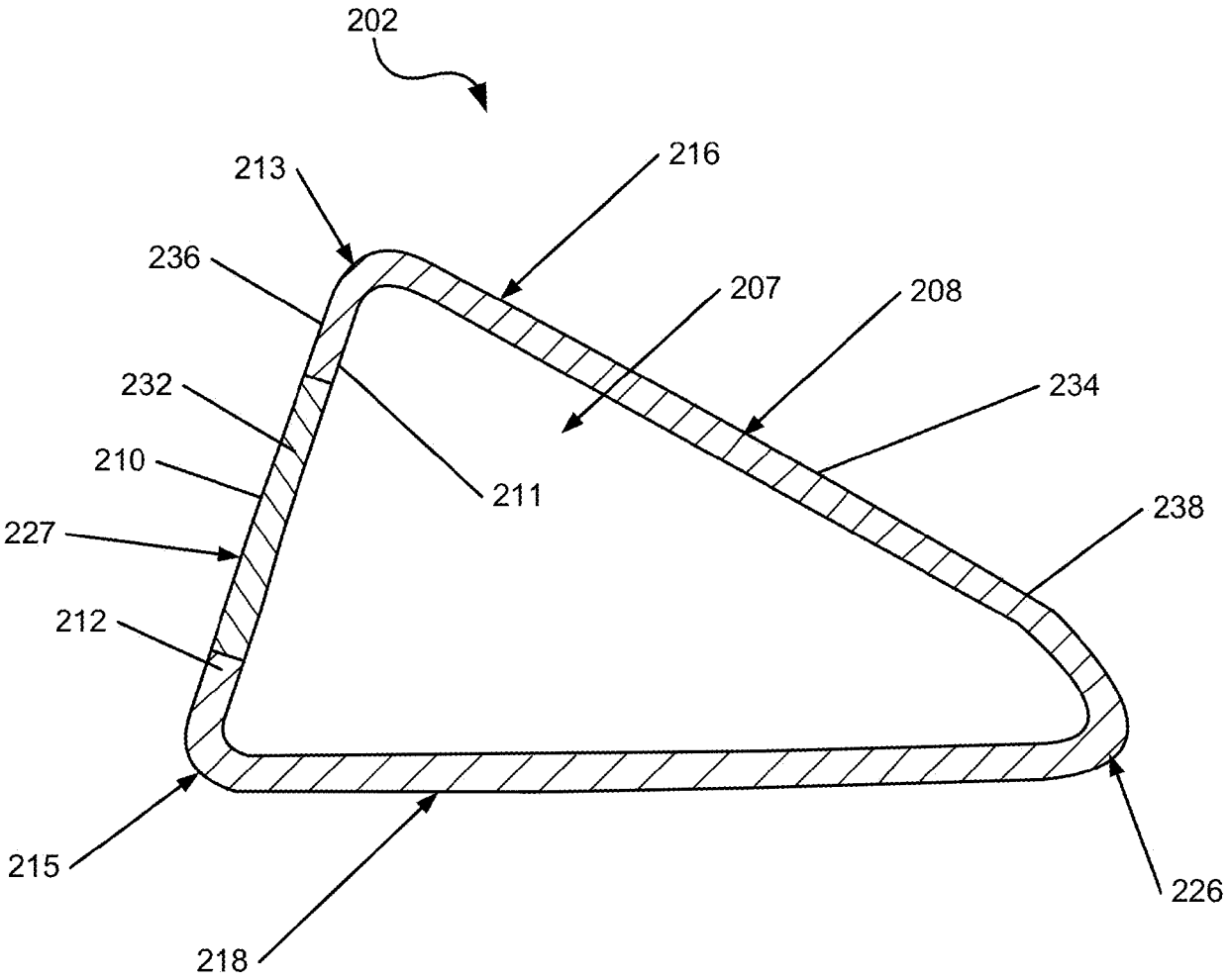
FIG. 6 is a cross-sectional view of another illustrative embodiment of a wood-type ball striking device according to aspects of the present invention.

In one embodiment, as shown in FIG. 6, the head 202 may include an insert or face member 232 connected to a body member 234 and forming at least a portion of the face 212. Many features of the head 202 of FIG. 6 are similar to the features of the head 102 shown in FIGS. 1-5, and such similar features are identified by similar reference numerals in FIG. 6 using the "2xx" series of reference numerals. Accordingly, certain features of the head 202 of FIG. 6 that are already described above may described below using less detail, or may not be described at all. In this embodiment, the face member 232 forms a portion of the face 212 and is formed of a different material from the other portions of the face 212, which may have a different modulus. Additionally, in this embodiment, the body member 234 forms the entire body 208 and a portion of the face 212 as well. It is understood that the face member 232 and/or the body member 234 may be formed of multiple pieces.

As shown in FIG. 6, the face 212 includes a face member 232 that is connected to the body member 234 and extends completely through the face 212 and forms part of the ball striking surface 210 and the inner surface 211 of the face 212. The face member 232 is connected to a front 236 of the body member 234, and the body member 234 further has a rear 238 that extends rearwardly from the front 236 to form all or a portion of the body 208. In this embodiment, the face member 232 is a circular piece located at or around the area of highest response 227 of the face 212, where impacts are most likely to occur. In other embodiments, the face member 232 may be positioned elsewhere, or may be differently shaped. For example, the face member 232 may be differently shaped or located based on a hitting pattern of a golfer, or the face member 232 may form a larger or smaller proportion of the ball striking surface 210, and may even form a majority or an entirety of the ball striking surface 210. The face member 232 may be connected to the body member 234 by adhesives, welding or other integral joining technique, or by another joining technique, including fasteners or other mechanical joining means. The head 202 of FIG. 6 may include any additional features or variations described herein with respect to other embodiments.

Figure 7:
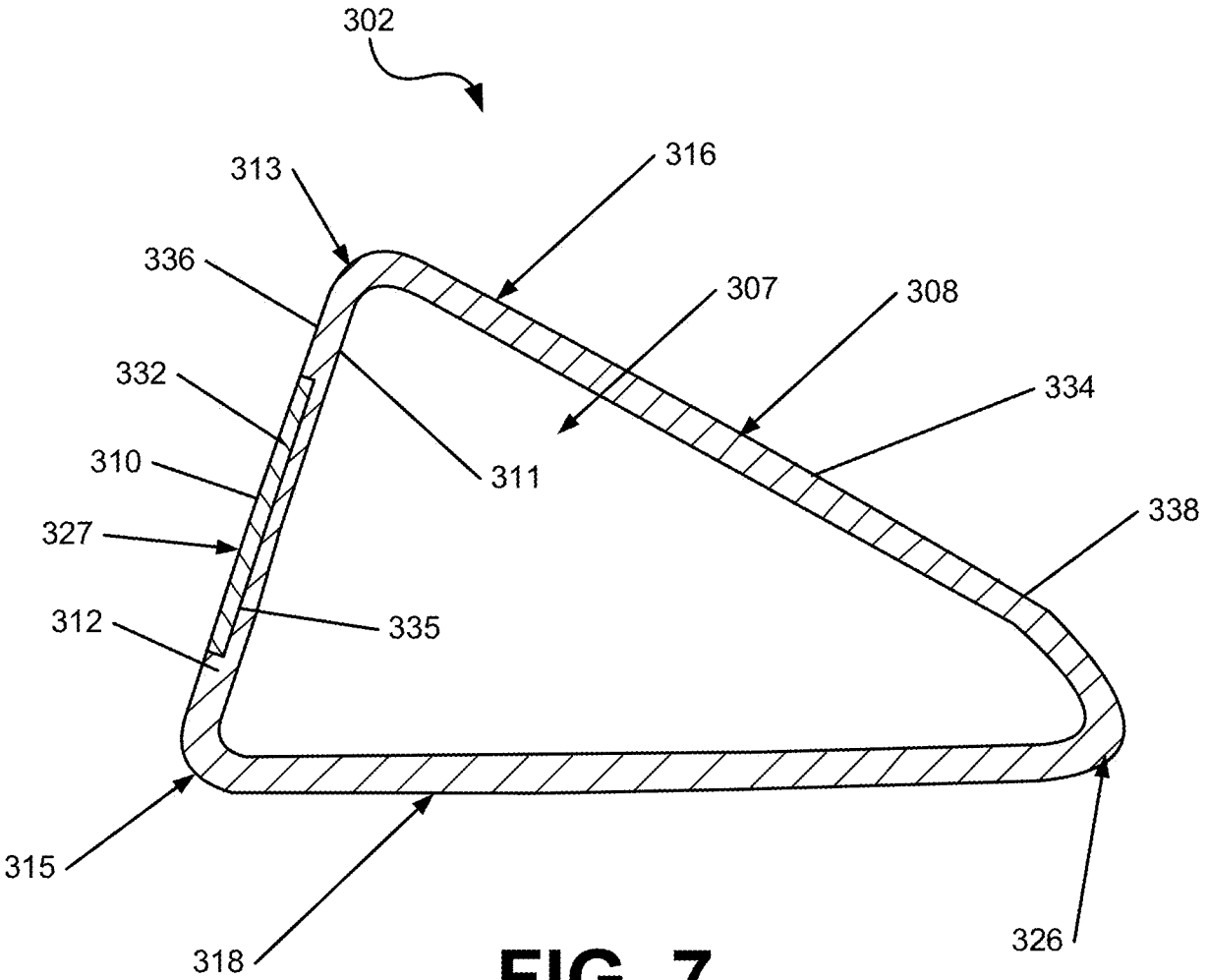
FIG. 7 is a cross-sectional view of another illustrative embodiment of a wood-type ball striking device according to aspects of the present invention.
Figure 8:
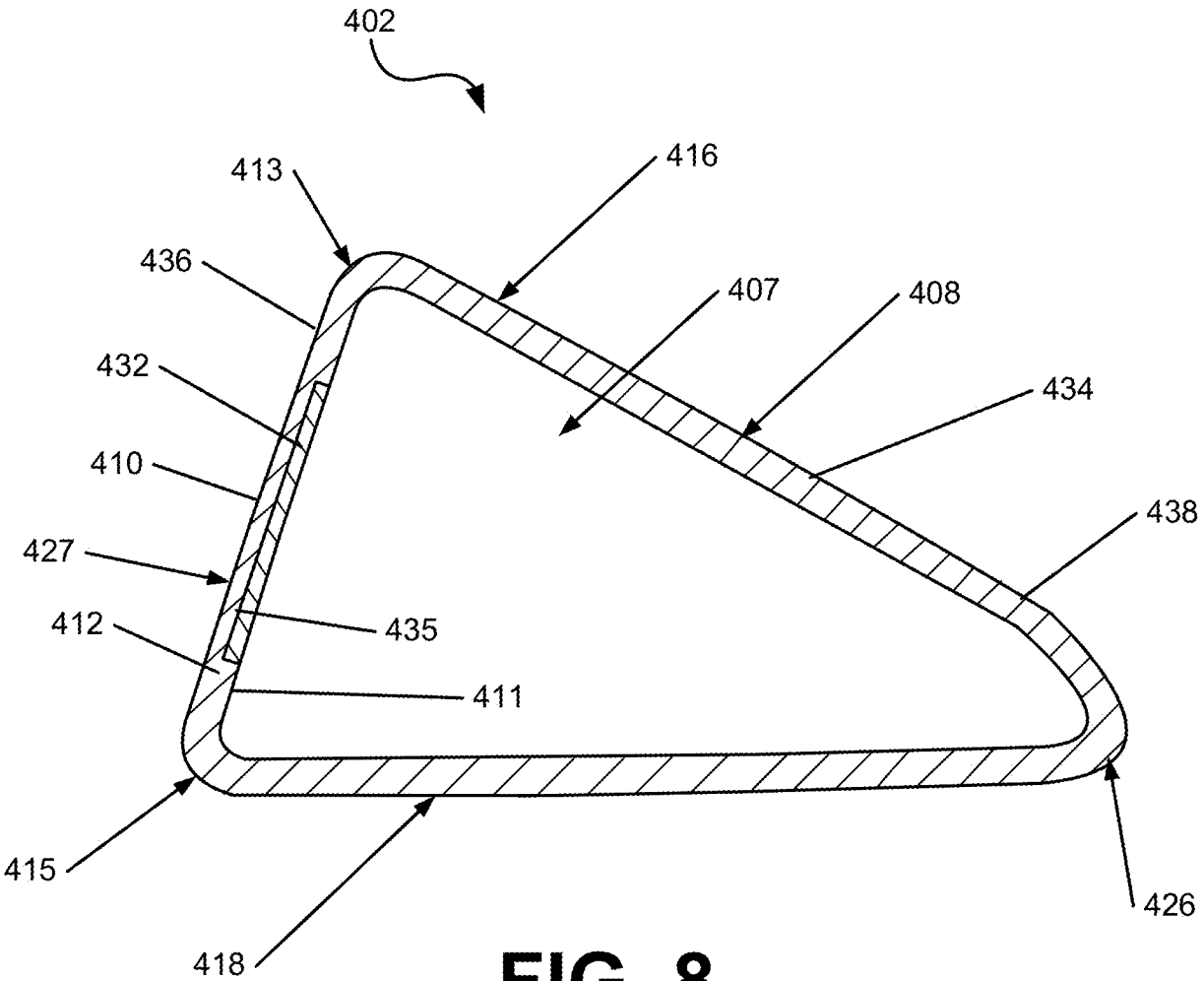
FIG. 8 is a cross-sectional view of another illustrative embodiment of a wood-type ball striking device according to aspects of the present invention.

FIGS. 7 and 8 illustrate other embodiments of heads 302, 402 that include face members 332, 432 connected to a body member 334, 434. Many features of the heads 302, 402 of FIGS. 7 and 8 are similar to the features of the heads 102, 202 shown in FIGS. 1-6, and such similar features are identified by similar reference numerals in FIGS. 7 and 8 using the "3xx" and "4xx" series of reference numerals, respectively. Accordingly, certain features of the heads 302, 402 of FIGS. 7 and 8 that are already described above may described below using less detail, or may not be described at all.

FIG. 7 illustrates an embodiment of a head 302 that includes a face member 332 that is received in a recess 335 in the ball striking surface 310 of the face 312. In this embodiment, the face member 332 forms a portion of the ball striking surface 310, and the body member 334 forms the entire body and the remainder of the face 312. The face member 332 is connected to a front 336 of the body member 334, and the body member 334 further has a rear 338 that extends rearwardly from the front 336 to form all or a portion of the body 308. It is understood that the body member 334 may include a separate piece forming portions of the face 312. As described above with respect to FIG. 6, the face member 332 can be formed in a circular shape or any other shape, and may be positioned at least partially in the area of highest response 327 of the face 312. As also described above, the face member 332 may have a different modulus from other portions of the face 312, so that the face member 332 can alter the vibration mode of the face 312 to enable matching with a golf ball 106. Additionally, the face member 332 may be connected within the recess 335 by adhesives, welding or other integral joining technique, or by another joining technique, including fasteners or other mechanical joining means. The head 302 of FIG. 7 may include any additional features or variations described herein with respect to other embodiments.

FIG. 8 illustrates an embodiment of a head 402 that includes a face member 432 that is received in a recess 435 in the inner surface 411 of the face 412. In this embodiment, the face member 432 forms a portion of the inner surface 411 of the face 412, and the body member 434 forms the entire body and the remainder of the face 412. The face member 432 is connected to a front 436 of the body member 434, and the body member 434 further has a rear 438 that extends rearwardly from the front 436 to form all or a portion of the body 408. It is understood that the body member 434 may include a separate piece forming portions of the face 412. As described above with respect to FIG. 6, the face member 432 can be formed in a circular shape or any other shape, and may be positioned at least partially in the area of highest response 427 of the face 412. As also described above, the face member 432 may have a different modulus from other portions of the face 412, so that the face member 432 can alter the vibration mode of the face 412 to enable matching with a golf ball 106. Additionally, the face member 432 may be connected within the recess 435 by adhesives, welding or other integral joining technique, or by another joining technique, including fasteners or other mechanical joining means. The head 402 of FIG. 8 may include any additional features or variations described herein with respect to other embodiments.

Figure 9:
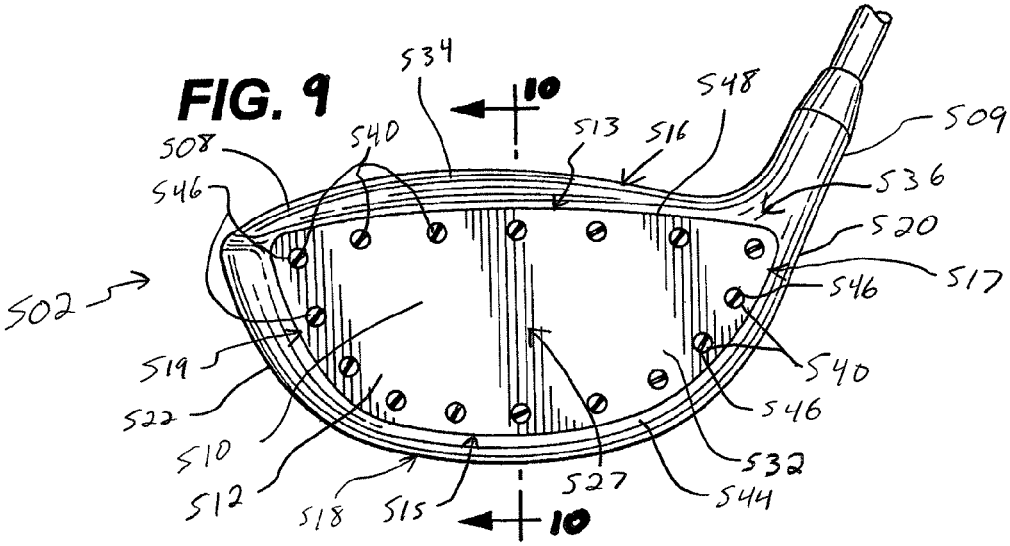
FIG. 9 is a front view of another illustrative embodiment of a wood-type ball striking device according to aspects of the present invention.
Figure 10:
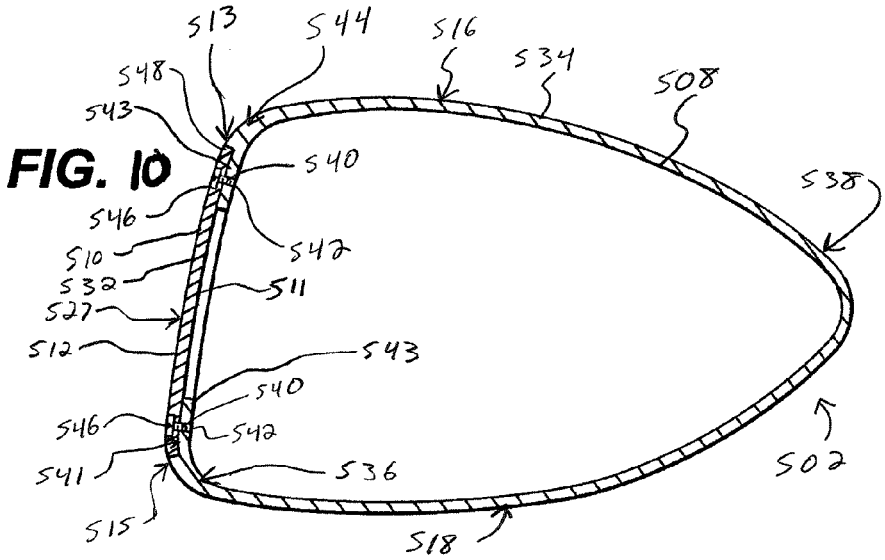
FIG. 10 is a cross-section view of the head of FIG. 9, taken along lines 10-10 of FIG. 9.

FIGS. 9-10 illustrate another embodiment of a head 502 having an insert or face member 532 connected to a body member 534 and forming at least a portion of the face 512. Many features of the head 502 of FIGS. 9-10 are similar to the features of the head 102 shown in FIGS. 1-5, and such similar features are identified by similar reference numerals in FIGS. 9-10 using the "5xx" series of reference numerals. Accordingly, certain features of the head 502 of FIGS. 9-10 that are already described above may described below using less detail, or may not be described at all. In this embodiment, the head 502 includes a face member 532 that makes up the entirety or the substantial entirety of the face 512, extending to the peripheral edges of the face 512, including the top, bottom, heel, and toe edges 513, 515, 517, 519. As such, the face member 532 in this embodiment makes up the entirety or the substantial entirety of the ball striking surface 510 and the inner surface 511 of the face 512. The face member 532 is connected to a front 536 of the body member 534, and the body member 534 further has a rear 538 that extends rearwardly from the front 536 to form all or a portion of the body 508. As described above, the face member 532 may have a different modulus from other portions of the head 502, and may be selected to provide a particular vibration mode. The face member 532 may be formed from a different material as the body member 534 to achieve such properties. Further, the face member 532 may itself contain one or more inserts or other members. For example, the face member 532 may contain an insert that is structured and/or positioned similarly to the face members 232, 332, 532 in FIGS. 6-8, described above. Such an insert may have a different modulus than the face member 532 or otherwise affect the vibration mode of the face member 532.

The face member 532 is connected to the body member 534 by a plurality of fasteners 540 in this embodiment. The body member 534 has a plurality of fastener holes 542 positioned around a periphery 544 of the front end 536, and the face member 532 has a plurality of fastener holes 546 positioned around the periphery 548 thereof, or in this embodiment, around the peripheral edges 513, 515, 517, 519 of the face 512. The fastener holes 546 of the face member 532 and the fastener holes 542 of the body member 534 are aligned with each other so that the fasteners 540 can extend through the face member 532 and be received in the fastener holes 546, 542 of the face member 532 and the body member 534 to connect the body member 534 to the face member 532. In this embodiment, the fasteners 540 are screws, but other embodiments may utilize different types of fasteners 540. Additionally, in this embodiment, the body member 534 has a recessed flange 543 that runs around the periphery 544 of the front end 536 and extends inwardly from the periphery 544. The flange 543 provides a recessed base for a recess 541 to receive the face member 532 therein, and also provides a location for the fastener holes 542.

Figure 11:
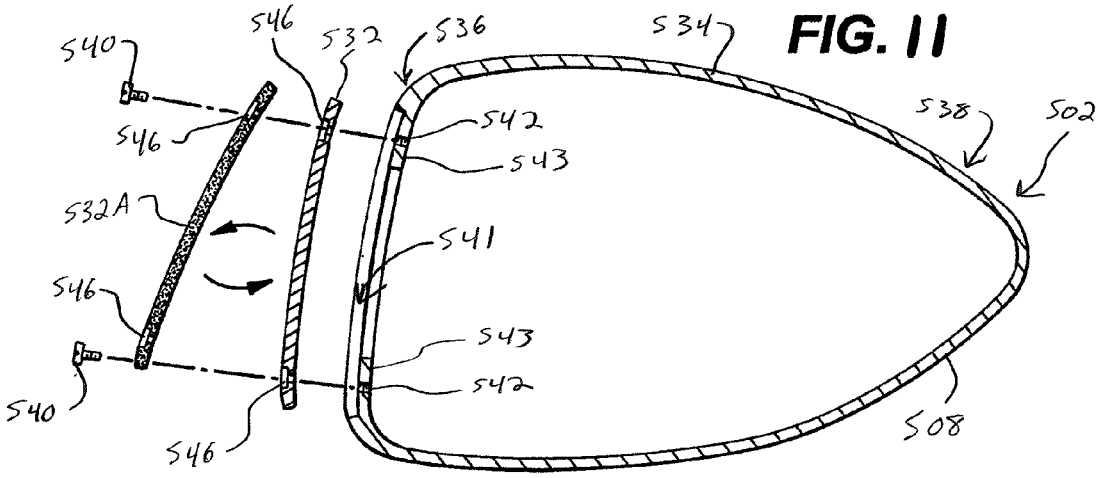
FIG. 11 is a schematic cross-section view of the head of FIG. 9, with the head shown having a face member being removed and interchanged with another face member.

In this embodiment, as illustrated in FIG. 11, the face member 532 can be removed and interchanged with another face member 532A. The second face member 532A may have a similar structure to the original face member 532, having fastener holes 546 to receive fasteners 540 therein. As shown in FIG. 11, interchanging can be performed by removing the fasteners 540, then removing the face member 532, and then connecting the second face member 532A to the front 536 of the body member 534 by re-inserting the fasteners 540. The second face member 532A may be selected based on various criteria, including having a different vibration mode than the original face member 532. The second face member 532A may also have different properties, such as a different flexibility or modulus, and/or may be formed of a different material. Further, the second face member 532A may be selected from a plurality of face members having similar structures and different properties, such as having different vibration modes. This can permit customization of the head 502 for a particular person by selecting a face member 532A based on desired properties and connecting the selected face member 532A to the body member 536, as described below. In other embodiments, the body member 534 and/or the face member 532 may have different structure for connection to each other, such as the head 602 shown in FIG. 12.

Figure 12:
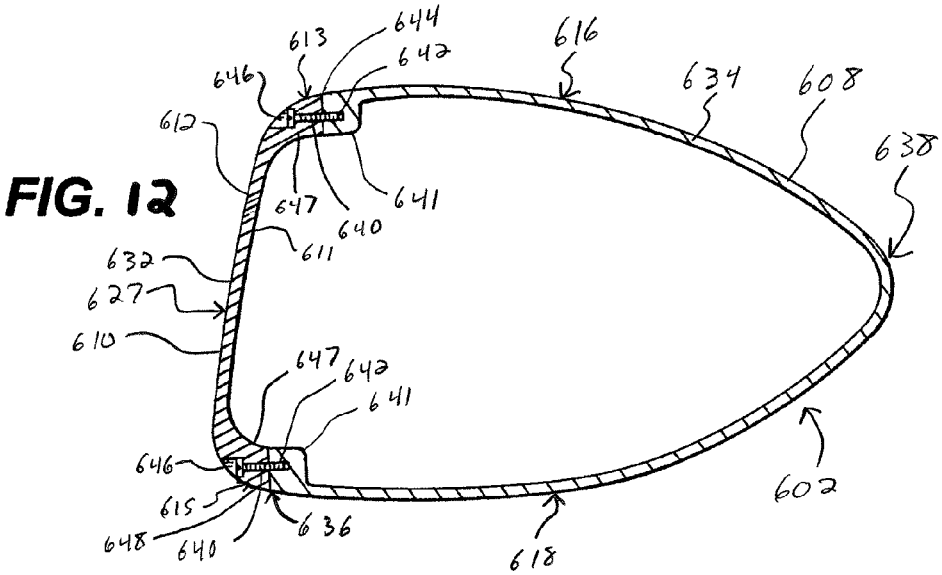
FIG. 12 is a cross-section view of another illustrative embodiment of a wood-type ball striking device according to aspects of the present invention.

FIG. 12 illustrates another embodiment of a head 602 having an insert or face member 632 connected to a body member 634 and forming at least a portion of the face 612. Many features of the head 602 of FIG. 12 are similar to the features of the head 102 shown in FIGS. 1-5, and such similar features are identified by similar reference numerals in FIG. 12 using the "6xx" series of reference numerals. Accordingly, certain features of the head 602 of FIG. 12 that are already described above may described below using less detail, or may not be described at all. In this embodiment, the head 602 includes a face member 632 that makes up the entirety or the substantial entirety of the face 612, extending to the peripheral edges of the face 612, including the top, bottom, heel, and toe edges 613, 615, 617, 619. As such, the face member 632 in this embodiment makes up the entirety or the substantial entirety of the ball striking surface 610 and the inner surface 611 of the face 612. The face member 632 is connected to a front 636 of the body member 634, and the body member 634 further has a rear 638 that extends rearwardly from the front 636 to form all or a portion of the body 608.

In this embodiment, the body member 634 has a block 641 extending around the periphery 644 of the front end 636 of the body member 634. The block 641 includes the fastener holes 642 therein, and the face member 632 contains fastener holes 646 aligned with the fastener holes 642 of the body member 634. Accordingly, the fasteners 640 can be used to connect the face member 632 to the body member 634 by extending through the fastener holes 642, 646. The face member 632 also has peripheral walls 647 extending rearwardly from the face 612, to form a cup-face structure, and the fastener holes 646 extend through the peripheral walls 647. It is understood that the structure of the head 602 of FIG. 12 may permit removal and interchanging of the face member 632 with another face member having a different vibration mode or other different property, as similarly shown in FIG. 11.

The fasteners 540, 640 connecting the face member 532, 632 to the body member 534, 634 in heads such as the heads 502, 602 of FIGS. 9-12 may be adjustable to change the vibration mode of the face 512, 612. This can provide greater freedom for customization and matching the vibration mode of the face 512, 612 to a ball 106. These features are described below with respect to the head 502 of FIGS. 9-10, however it is understood that the head 602 of FIG. 12 can utilize the same or similar features, as well as other embodiments having other structures.

In one embodiment, one or more of the fasteners 540 connecting the face member 532 to the body member 534 can be tightened or loosened to adjust the vibration mode of the face 512. Tightening or loosening the fastener(s) 540 can change the stiffness of the face 512 at areas located around the tightened or loosened fastener(s) 540, thereby changing the vibration mode of the face 512. Adjusting different fasteners 540 may have different effects on the degree of change of the vibration mode and/or the size and shape of the affected area, and as such, the fasteners 540 that are to be adjusted can be selected to achieve differently-configured vibration modes as desired. Further, fasteners 540 having different weights may be used to influence the stiffness of the face 512 and/or the weighting of the head 502. For example, fasteners 540 made from a sufficiently light material (e.g. aluminum, polymer) or dense material (e.g. tungsten) may be used in place of a steel or titanium fastener 540.

Figure 13:
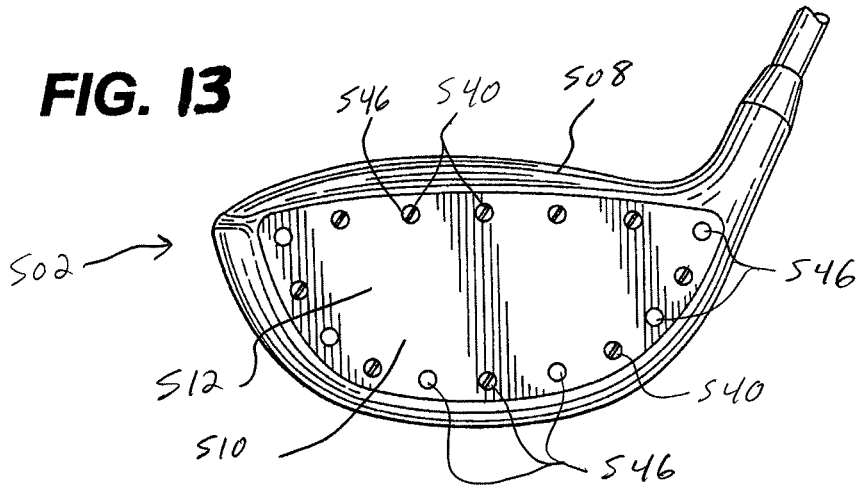
FIG. 13 is a front view of the head of FIG. 9, having one configuration of fasteners connecting a face member to a body member of the head.
Figure 14:
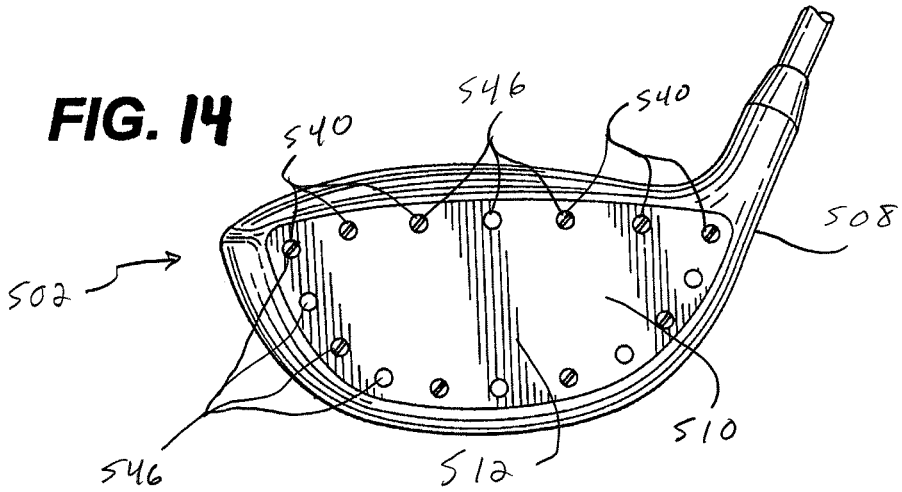
FIG. 14 is a front view of the head of FIG. 9, having another configuration of fasteners connecting a face member to a body member of the head.
Figure 15:
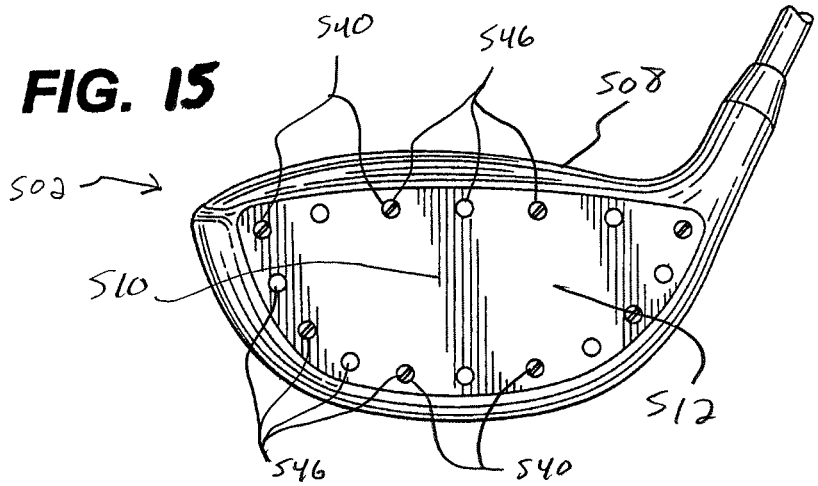
FIG. 15 is a front view of the head of FIG. 9, having another configuration of fasteners connecting a face member to a body member of the head.

In another embodiment, the positions of one or more of the fasteners 540 connecting the face member 532 to the body member 534 can be changed to adjust the vibration mode of the face 512. For example, the number of fasteners 540 may be smaller than the number of fastener holes 546 in the face member 532, and thus, one or more of the fastener holes 546 may have no fastener 540 received within. This enables the positions of the fasteners 540 to be changed, which can change the tension and stiffness at the edges of the face 512 and thereby change the vibration mode of the face 512. In the embodiment shown in FIGS. 9-10, all of the fastener holes 546 have fasteners 540 received therein. FIGS. 13-15 illustrate embodiments where fewer than all the fastener holes 546 contain fasteners 540, allowing for adjusting the positions of the fasteners. As seen in FIG. 13, the fasteners 540 are in a first configuration or arrangement, and some of the fasteners 540 can be moved to create a second configuration or arrangement shown in FIG. 14. The face 512 has a different vibration mode when the fasteners 540 are in the second configuration as compared to the first configuration. Additionally, adjusting the positions of the fasteners 540 may include adding or removing fasteners 540 from the head 502. As an example, FIG. 15 illustrates a third configuration of arrangement of fasteners 540 that includes fewer fasteners 540 than the embodiments in FIGS. 13-14. Adjusting the head 502 from the first or second fastener 540 configurations to the third configuration shown in FIG. 15 can change the vibration mode of the head 502. Similarly, the head 502 can be adjusted from the configuration of FIG. 15 to configurations of FIGS. 13-14 by moving selected fasteners 540 to change the vibration mode of the face 512, including adding fasteners 540 to the head 502. Further types of fastener 540 adjustments may be made in other embodiments to achieve adjustment of the vibration mode of the face 512. It is understood that temporary or permanent plugs may be inserted into any empty fastener holes 546 to create a consistently flat face 512.

A variety of different materials and combinations of materials may be used to construct the face 112 and/or portions of the face 112, such as face members/inserts or portions thereof as described below. Such materials may include metals such as titanium, aluminum, steels (including stainless steels), and other metals, including alloys thereof. Metal foams, including integral skin foams, may also be used. Additionally, one or more polymer materials may be used in connection with the face 112, to produce various modulus or flexibility effects to control the vibration mode of the face 112, including materials such as: unsaturated thermosetting polyesters (e.g. like to those used in fiberglass), vinyl ester resins, epoxy, polyurethane, polyurea, polyimide, phenolic or phenol-formaldehyde resin (e.g. Bakelite), furan (furfural alcohol based) resins, melamine (melamine-formaldehyde) resin, urea-formaldehyde resin, cyanate esters (polycyanurates), allyl resins (e.g. diallyl phthalate or DAP), bismaleimide, polymethacrylimide, cyanoacrylates, thermosetting acrylics and methacrylates, alkyd resin, silicones, rubber (natural or synthetic aka polyisoprene), and synthetic rubber/elastomers including butadiene, butyl, chlorobutyl, chloroprene/neoprene, chlorosulfonated/Hypalon, epichlorohydrin, ethylene-propylene, EPDM (ethylene propylene diene monomer), fluorinated (Viton, Kalrez), fluorosilicone, nitrile, hydrogenated nitrile, styrene butadiene, and SEBS (styrene ethylene/butadiene styrene). A blend or combination of one or more of these polymeric materials may also be used, possibly along with fibers or fillers to create a composite material, or additives, etc.

Materials used in the face 112 may also include composite materials, including a reinforcement-matrix composite, such as fiber-matrix composites including fiberglass, carbon-fiber composites, etc., as well as layered composites and other types of composites. Typically, a reinforcement-matrix composite includes at least one reinforcing material (such as a fiber material) and at least one matrix material, which may be a polymer material, where the matrix material has a different (often lower) modulus than the reinforcing material. In one embodiment, the head 102 may have a metal face 112 with an insert or face member formed of a polymeric or composite material as described above, such as the members 232, 332, 432 shown in FIGS. 6-8, or may have a metallic face member such as the members 532, 632 as shown in FIGS. 9-12 that has a portion (such as an additional insert) formed of a polymeric or composite material as described above.

Figure 16:
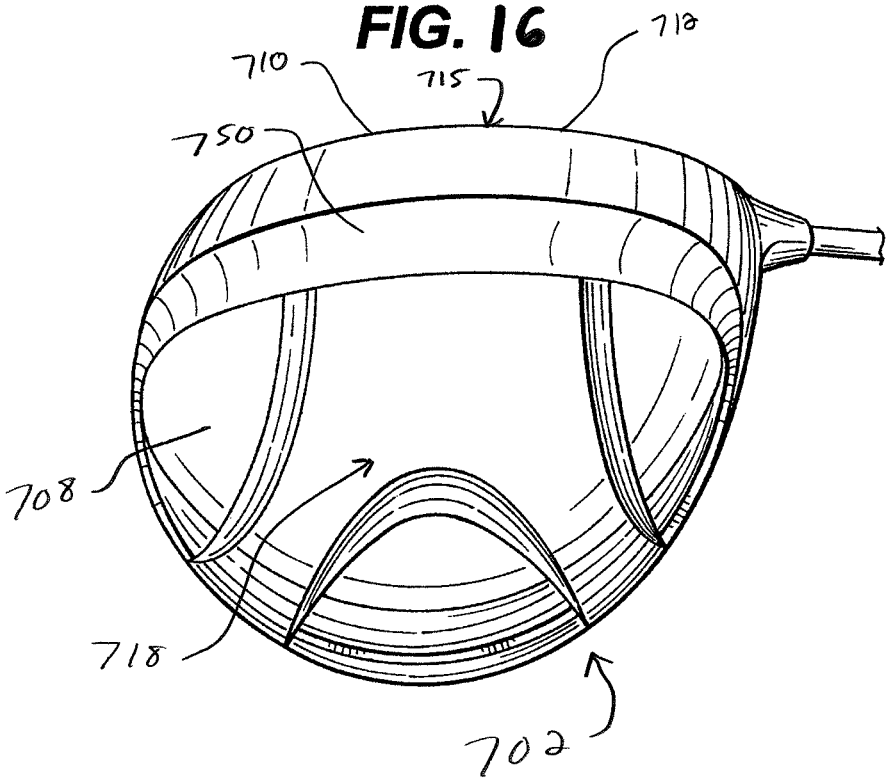
FIG. 16 is a bottom view of another illustrative embodiment of a head of a wood-type ball striking device according to aspects of the present invention.
Figure 17:
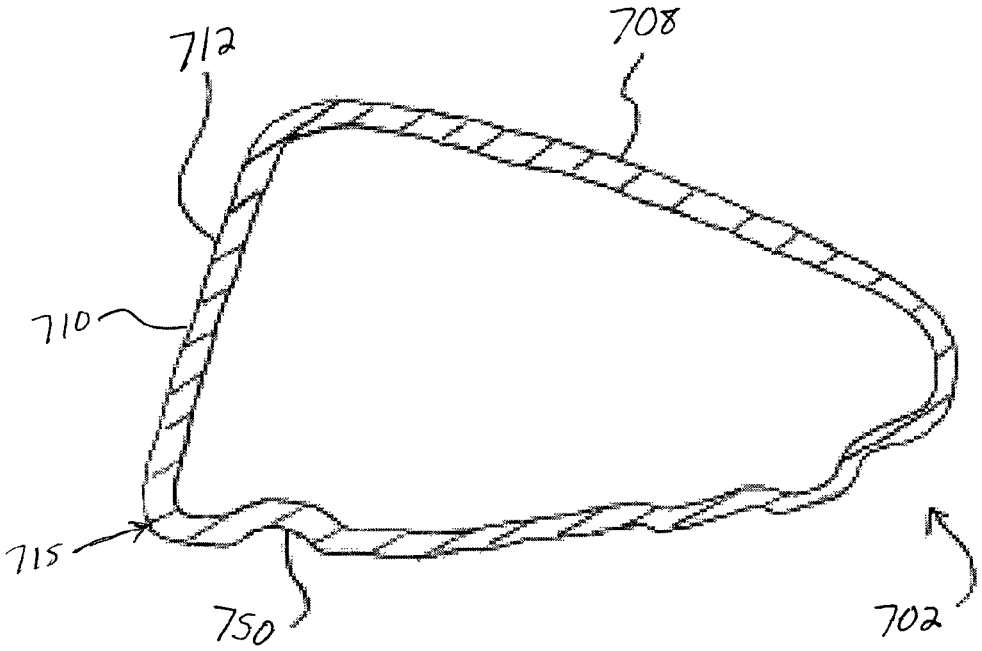
FIG. 17 is a cross-section view of the head of FIG. 16, taken along lines 17-17 of FIG. 16.
Figure 18:
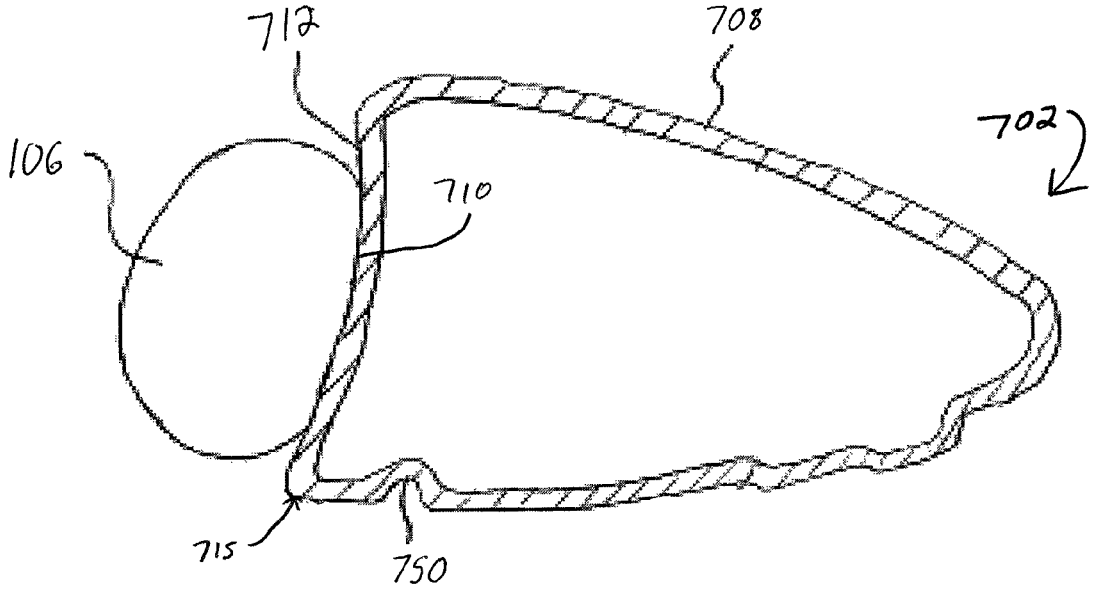
FIG. 18 is a cross-section view showing the head of FIG. 16, during impact of a ball on a ball striking face of the head.

The face features described above can also be used in connection with a club head 702 as shown in FIGS. 16-18, having a compression channel 750 located on the sole 718 of the body 708, along the bottom edge 715 of the face 712. Many features of the head 702 of FIGS. 16-18 are similar to the features of the head 102 shown in FIGS. 1-5, and such similar features are identified by similar reference numerals in FIGS. 16-18 using the "7xx" series of reference numerals. Accordingly, certain features of the head 702 of FIGS. 16-18 that are already described above may described below using less detail, or may not be described at all. In this embodiment, the face 712 and the channel 750 both flex during impact and combine to absorb the force of the impact with the ball 106, as seen in FIG. 18. As such, a compression channel 750 can influence the vibration mode of the face 712, and in one embodiment, one or more compression channels 750 can be used for that purpose. Other types and configurations of compression channels can be used as well, including compression channels that extend adjacent other edges of the face 712.

Figure 19:
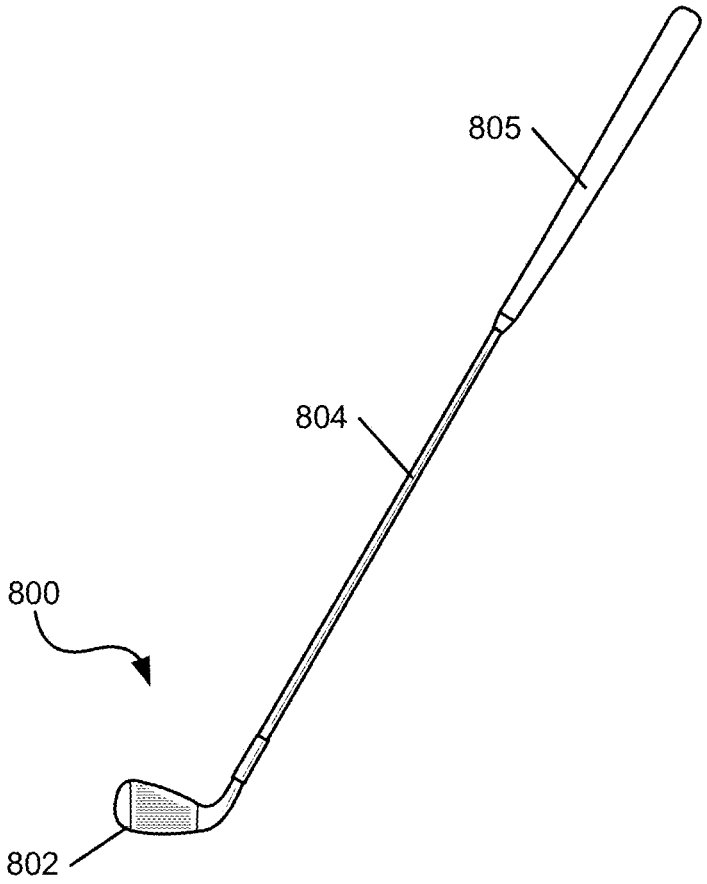
FIG. 19 is a front view of an illustrative embodiment of an iron-type ball striking device according to aspects of the present invention.
Figure 20:
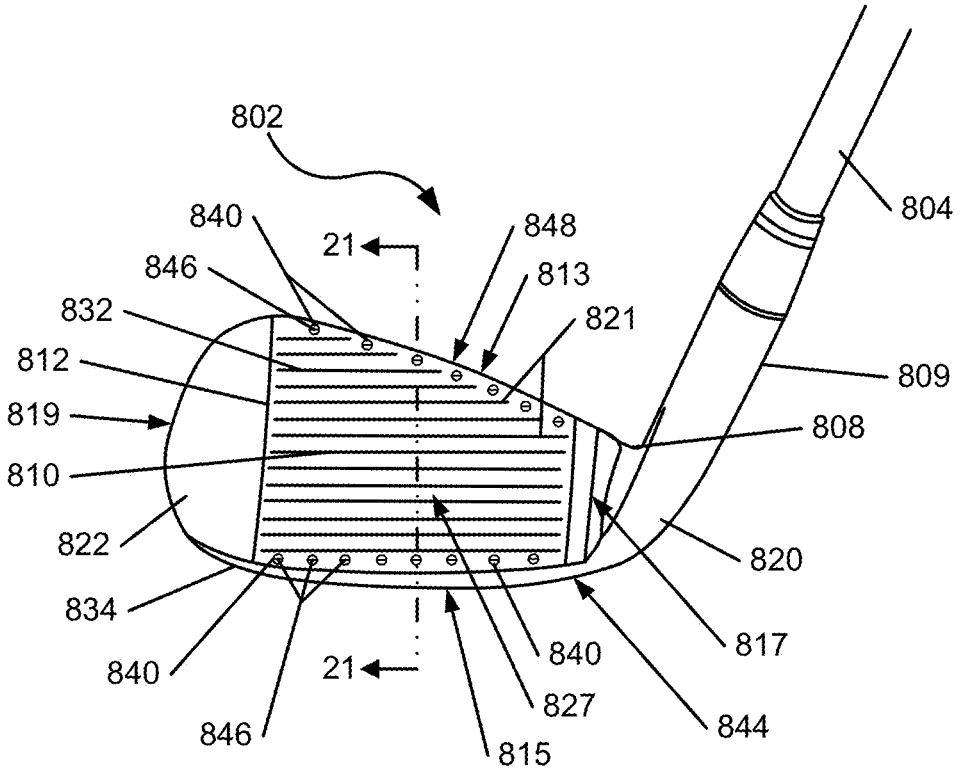
FIG. 20 is a front view of a head of the iron-type ball striking device of FIG. 19.
Figure 21:
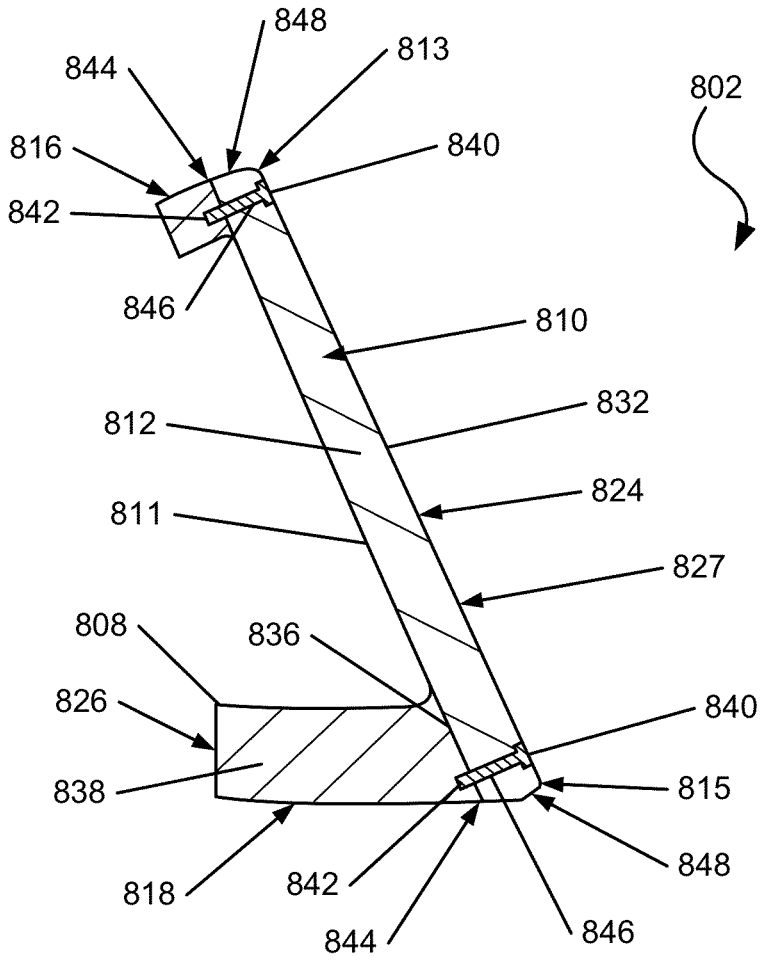
FIG. 21 is a cross-section view of the head of FIG. 20, taken along lines 21-21 of FIG. 20.

FIGS. 19-21 illustrate a ball striking device 800 in the form of a golf iron, in accordance with at least some examples of this invention. Many common components between the ball striking device 100 of FIGS. 1-5 and the ball striking device 800 of FIGS. 19-21 are referred to using similar reference numerals in the description that follows, using the "8xx" series of reference numerals. The ball striking device 800 includes a shaft 804 and a golf club head 802 attached to the shaft 804. The golf club head 802 of FIGS. 20-21 may be representative of any iron or hybrid type golf club head in accordance with examples of the present invention.

As shown in FIGS. 19-21, the golf club head 802 includes a body member 808 having a face 812 and a hosel 809 extending from the body 808 for attachment of the shaft 804. For reference, the head 802 generally has a top 816, a bottom or sole 818, a heel 820 proximate the hosel 809, a toe 822 distal from the hosel 809, a front 824, and a back or rear 826. The shape and design of the head 802 may be partially dictated by the intended use of the device 800. The heel portion 820 is attached to and/or extends from a hosel 809 (e.g., as a unitary or integral one piece construction, as separate connected elements, etc.). The body 808 of the head 802 in FIGS. 19-21 is a cavity-back design, and it is understood that the features described herein can be used with other iron-type club heads, such as partial-cavity heads, cavity heads with a rear wall or bridge member across the rear 826 of the head 802, blade-type iron heads, etc.

The face 812 is located at the front 824 of the head 802, and has an outer surface 810, as well as a rear surface 811 located opposite the outer surface 810, which may be considered an inner surface of the face 812. The face 812 is defined by a plurality of peripheral edges, including a top edge 813, a bottom edge 815, a heel edge 817, and a toe edge 819. The face 812 also has a plurality of face grooves 821 on the ball striking surface 810. For reference purposes, the portion of the face 812 nearest the top face edge 813 and the heel 820 of the head 802 is referred to as the "high-heel area"; the portion of the face 812 nearest the top face edge 813 and toe 822 of the head 802 is referred to as the "high-toe area"; the portion of the face 812 nearest the bottom face edge 815 and heel 820 of the head 802 is referred to as the "low-heel area"; and the portion of the face 812 nearest the bottom face edge 815 and toe 822 of the head 802 is referred to as the "low-toe area". Conceptually, these areas may be recognized and referred to as quadrants of substantially equal size (and/or quadrants extending from a geometric center of the face 812), though not necessarily with symmetrical dimensions. The face 812 may include some curvature in the top to bottom and/or heel to toe directions (e.g., bulge and roll characteristics), as is known and is conventional in the art. The ball striking surface 810 is inclined (i.e., at a loft angle), to give the ball an appreciable degree of lift and spin when struck. In various embodiments, the ball striking surface 810 may have a different incline or loft angle, to affect the trajectory of the ball.

The body member 808 of the golf club head 802 may be constructed from a wide variety of different materials, including materials described above, such as steel, titanium, aluminum, tungsten, graphite, polymers, or composites, or combinations thereof. Also, if desired, the club head 802 may be made from any number of pieces (e.g., having a separate face plate, etc.) and/or by any construction technique, including, for example, casting, forging, welding, and/or other methods known and used in the art. The face 812 may be constructed using any of the materials described above, or combinations thereof, to create a face 812 with a desired vibration mode.

The ball striking device 800 may include a shaft 804 connected to or otherwise engaged with the ball striking head 802, as shown in FIG. 19 and described above. The shaft 804 is adapted to be gripped by a user to swing the ball striking device 800 to strike the ball. The shaft 804 can be formed as a separate piece connected to the head 802, such as by connecting to the hosel 809, as shown in FIG. 19. Any desired hosel and/or head/shaft interconnection structure may be used without departing from this invention, including those described above.

The club head features described above, including the various embodiments of inserts or face members described above, can also be used in connection with an iron-type club, a hybrid-type club, or other club types. As one example, in the embodiment illustrated in FIGS. 20-21, the head 802 includes a face member 832 that makes up the entirety or the substantial entirety of the face 812, extending to the peripheral edges of the face 812, including the top, bottom, heel, and toe edges 813, 815, 817, 819. As such, the face member 832 in this embodiment makes up the entirety or the substantial entirety of the ball striking surface 810 and the inner surface 811 of the face 812. The face member 832 is connected to a front 836 of the body member 834, and the body member 834 further has a rear 838 that extends rearwardly from the front 836 to form all or a portion of the body 808. As described above, the face member 832 may have a different modulus from other portions of the head 802, and may be selected to provide a particular vibration mode. Further, the face member 832 may itself contain one or more inserts or other members. For example, the face member 832 may contain an insert that is structured and/or positioned similarly to the face members 232, 332, 532 in FIGS. 6-8, described above. Such an insert may have a different modulus than the face member 832 or otherwise affect the vibration mode of the face member 832. The head 802 of FIGS. 20-21 may include any additional features or variations described above with respect to other embodiments, and the components of the head 802, including the face member 832 and the body member 834, can be made from any of the materials described above.

The face member 832 is connected to the body member 834 by a plurality of fasteners 840 in this embodiment, similar to the head 502 in FIGS. 9-10. The body member 834 has a plurality of fastener holes 842 positioned around a periphery 844 of the front end 836, and the face member 832 has a plurality of fastener holes 846 positioned around the periphery 848 thereof, or in this embodiment, around the peripheral edges 813, 815, 817, 819 of the face 812. The fastener holes 846 of the face member 832 and the fastener holes 842 of the body member 834 are aligned with each other so that the fasteners 840 can extend through the face member 832 and be received in the fastener holes 846, 842 of the face member 832 and the body member 834 to connect the body member 834 to the face member 832. In this embodiment, the fasteners 840 are screws, but other embodiments may utilize different types of fasteners 840. In other embodiments, the body member 834 and/or the face member 832 may have different structure for connection to each other. It is understood that the face member 832 in FIGS. 20-21 can be removed and interchanged similarly to the face members 532, 532A described above and shown in FIG. 11.

Figure 22:
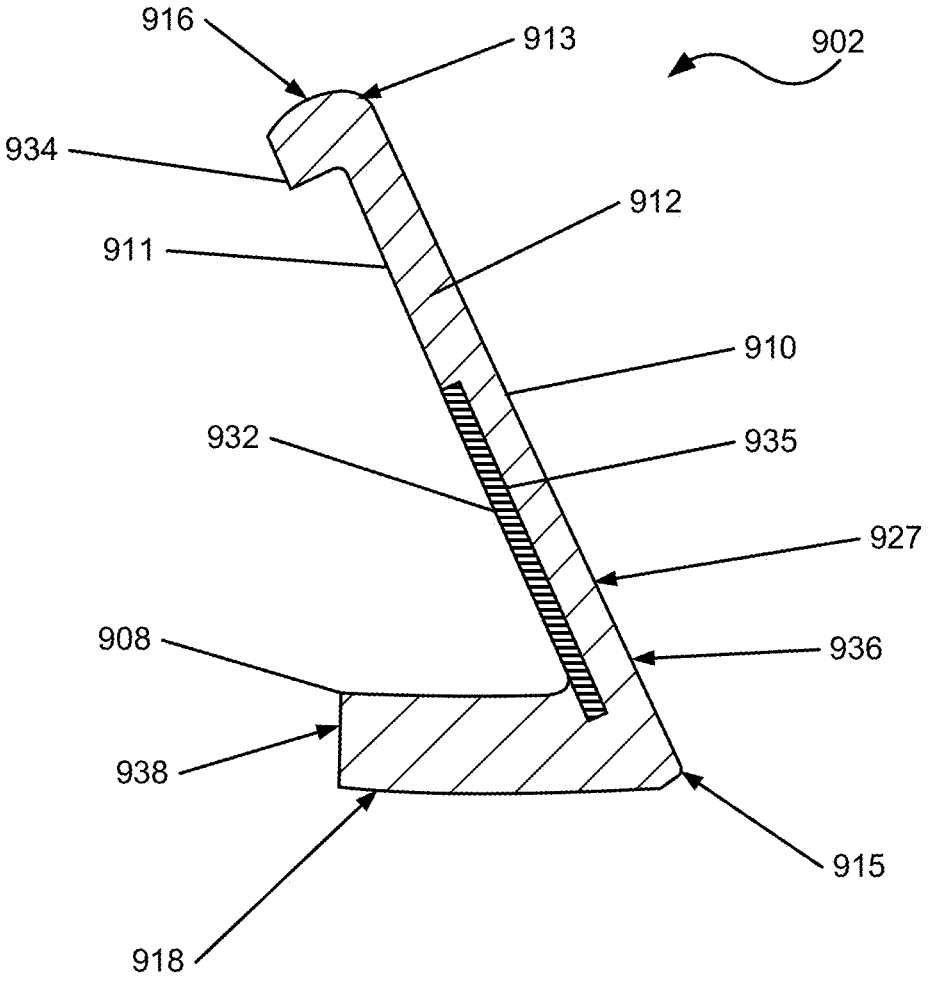
FIG. 22 is a cross-section view of another embodiment of a head that is usable with an iron-type ball striking device as shown in FIG. 19.

As another example, an iron-type golf club head may include an insert or face member similar to the face members 232, 332, 432 described above and shown in FIGS. 6-8. For example, in the embodiment shown in FIG. 22, the iron-type head 902 includes a face member 932 that is received in a recess 936 in the inner surface 911 of the face 912, similar to the face member 432 of FIG. 8. In this embodiment, the face member 932 forms a portion of the inner surface 911 of the face 912, and the body member 934 forms the entire body and the remainder of the face 912. The face member 932 is connected proximate a front 936 of the body member 934, and the body member 934 further has a rear 938 that extends rearwardly from the front 936 to form all or a portion of the body 908. It is understood that the body member 934 may include a separate piece forming portions of the face 912. As described above with respect to FIG. 6, the face member 932 can be formed in a circular shape or any other shape, and may be positioned at least partially in the area of highest response 927 of the face 912. As also described above, the face member 932 may have a different modulus from other portions of the face 912, so that the face member 932 can alter the vibration mode of the face 912 to enable matching with a golf ball 106. Additionally, the face member 932 may be connected within the recess 935 by adhesives, welding or other integral joining technique, or by another joining technique, including fasteners or other mechanical joining means. The head 902 of FIG. 22 may include any additional features or variations described above with respect to other embodiments, and the components of the head 902, including the face member 932 and the body member 934, can be made from any of the materials described above.

Several different embodiments have been described above, including the various embodiments of golf clubs 100, 800 and heads 102, 202, 302, 402, 502, 602, 702, 802, 902 (referred to herein as 102, et seq.) and portions thereof described herein. It is understood that any of the features of these various embodiments may be combined and/or interchanged. For example, as described above, various different combinations of club heads 102, et seq. with differently configured faces 112, et seq., including different inserts or face members, may be used, including the configurations described herein, variations or combinations of such configurations, or other configurations. In one particular example, any of the club heads 102, et seq., described herein may include an indicator, such as the indicator 130 described above. In further embodiments, at least some of the features described herein can be used in connection with other configurations of iron-type clubs, wood-type clubs, other golf clubs, or other types of ball-striking devices.

Heads 102, et seq. incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head with a face that has a vibration mode that is matched with at least one ball, and may include an indicator and/or a face member or insert, as described above.

Additionally, as described above, the head 102, et seq., golf club 100, et seq., or other ball striking device may be customized for a person in several different ways. In one embodiment, such customization can be accomplished by determining a swing speed for the person and selecting at least one of a ball striking head and/or a ball based on the vibration modes of the face of the ball striking head and/or the ball at the determined swing speed.

In another embodiment, such customization can be accomplished by determining the swing speed for the person and selecting a face member as described above from a plurality of face members having different vibration modes. Such selection can be based on the swing speed and the vibration mode of the face member. The selected face member can then be connected to the head as described above. A ball may also be selected based on the vibration mode of the face member. This embodiment may further incorporate interchanging the selected face member with an existing face member, as described above.

In a further embodiment, such customization can be accomplished by changing or adjusting the vibration mode of the face in a manner as described above, such as by adjusting at least one fastener that connects the face member to the body member. For example, as described above, this adjustment may be accomplished by tightening or loosening one or more of the fasteners, or by changing the position of one or more of the fasteners, including moving a fastener to a different fastener hole, adding a fastener to a previously-empty fastener hole, and/or removing a fastener from a fastener hole. The vibration of the faces 112, et seq., of at least some of the embodiments herein may be adjusted by changing the face mass, the face compliance, and/or the impedance associated with the interface between the face 112, et seq., and the rest of the head 102, et seq. Face mass and face compliance are controlled primarily by the material properties (e.g., Young's modulus) and dimensions. Interface impedance can be adjusted by any of several methods. For example, in an embodiment (e.g., FIGS. 9-15) where the face 512 is connected to the rest of the club head 502 by fasteners 540 such as screws, then compliance may be changed by adjusting the clamp load (i.e. the positions and/or tightness of the fasteners 540). Compliance also may be influenced by installing a material such as an elastomer at the interface between the face 112, et seq., and the rest of the club, in a similar fashion as an O-ring or gasket might be used. In other words, the compliance between the face and the rest of the club head could be adjusted through at least one or more of the following: the material modulus, loss factor, shape, and/or contact area.

Additionally, the size, shape, and location of any face inserts or face members 232, et seq., utilized herein may be adjusted based on a common hitting pattern of a golfer. In one embodiment, moving or adjusting the fasteners 540, et seq., connecting the face member 532, et seq., to the body member 534 et seq., may not only change the vibration mode of the face 512, et seq., but may also change the shape of the area of the face 512, et seq., that is matched to a particular ball, allowing for customization to a particular golfer's hitting (or mis-hitting) patterns. Further, inserts or face members may be interchanged or replaced based on customization to a particular golfer or customization to specific play conditions. Still other options for customization are possible.

The ball striking devices and heads therefor as described herein provide many benefits and advantages over existing products. For example, as described above, when the vibration modes of the ball and the face are the same or substantially the same, vibrational damping factors during impact between the ball and the face can be minimized, which can result in increased energy transfer and ball velocity. This can, in turn, create added distance on shots made using the ball striking device. When the vibration modes of the ball and the face are mismatched, the impact may not generate as much energy and velocity, as part of the energy of the impact may be dissipated in the ball and/or in the face. Additionally, the structures of the face members or inserts described above allow for customization of the vibration mode of the face or to replace the face with a different face having a different vibration mode, which can be used to match the head to specific balls and/or customize the head to a golfer's swing speed. Still other benefits and advantages are readily recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A wood-type golf club head comprising:

a face member forming a face having a ball striking surface defined by peripheral edges and an inner surface opposite the ball striking surface, the face member having a plurality of fastener holes positioned around the peripheral edges of the ball striking surface;

a body member connected to the face member, the body member having a front end having a plurality of fastener holes positioned thereon and a rear end extending rearwardly from the front end to form a wood-type body extending rearward from the face, the fastener holes of the body being aligned with the fastener holes of the face member, wherein the body member and the face member define an internal cavity behind the face; and a plurality of fasteners received through the fastener holes of the face member and the fastener holes of the body member to connect the face member to the body member, wherein a number of the plurality of fastener holes of the face member and the plurality of fastener holes of the body member is greater than a number of the fasteners connecting the body member to the face member, such that a plug is positioned in at least a first fastener hole of the face member and at least a first fastener hole of the body member is empty.

2. The golf club head of claim 1, further comprising an indicator associated with the club head, the indicator identifying a golf ball based on a vibration mode of the golf ball, wherein the club head is configured to be used to strike the golf ball on the ball striking surface.

3. The golf club head of claim 1, further comprising:

an indicator associated with the club head, the indicator identifying a golf ball for use with the club head based on a vibration mode of the golf ball and based on the vibration mode of the face, wherein the club head is configured for striking the golf ball on the ball striking surface.

4. The golf club head of claim 3, wherein the indicator identifies a golf ball type, wherein the golf ball and a plurality of other golf balls belong to the golf ball type.

5. The golf club head of claim 3, wherein the indicator is positioned on the body of the golf club head.

6. The golf club head of claim 3, wherein the indicator is formed by at least one structure selected from the group consisting of: a sticker with an adhesive connection; embossing, engraving, or other integral forming; paint, ink, dye, or other pigment; and combinations thereof.

7. The golf club head of claim 3, wherein the indicator is included in a written manual associated with the golf club head.

8. The golf club head of claim 3, wherein the indicator comprises alphanumeric indicia identifying the golf ball.

9. The golf club head of claim 3, wherein the indicator comprises color coded indicia identifying the golf ball.

10. The golf club head of claim 3, wherein the indicator further indicates a swing speed associated with the golf ball.

11. The golf club head of claim 10, wherein the indicator further identifies a second golf ball and a second swing speed associated with the second golf ball, wherein the second swing speed is different from the first swing speed.

12. A golf club comprising the golf club head of claim 3 and a shaft connected to the head, wherein the indicator is positioned on at least one of the club head and the shaft.

* * * * *